US005878752A

United States Patent [19]

Adams et al.

[11] Patent Number: 5,878,752

[45] Date of Patent: Mar. 9, 1999

[54] METHOD AND APPARATUS FOR USING, CLEANING, AND MAINTAINING ELECTRICAL HEAT SOURCES AND LIGHTERS USEFUL IN SMOKING SYSTEMS AND OTHER APPARATUSES

[75] Inventors: John M. Adams, Mechanicsville; William J. Crowe, Chester; Grier S. Fleischhauer, Midlothian; Jay A. Fournier, Richmond; Mohammad R. Hajaligol, Richmond; Willie G. Houck, Jr., Richmond; Donald B. Losee, Richmond; Constance H. Morgan, Richmond; John D. Naworal, Midlothian; H. Neal Nunnally, Richmond; John B. Paine, III, Midlothian; Wynn R. Raymond, Chesterfield; Robert L. Ripley, Midlothian; Jeffrey I. Seeman, Richmond; Francis M. Sprinkel, Glen Allen; Michael L. Watkins, Chester, all of Va.

[73] Assignee: Philip Morris Incorporated, New York, N.Y.

[21] Appl. No.: 756,223

[22] Filed: Nov. 25, 1996

[51] Int. Cl.[6] ..... A24F 47/00

[52] U.S. Cl. ..... 131/329; 131/194

[58] Field of Search ..... 131/329, 194, 131/271, 270, 273; 128/202.21, 203.27 A

[56] References Cited

U.S. PATENT DOCUMENTS 3,559,300 2/1971 Fox .
5,249,586 10/1993 Morgan .
5,388,594 2/1995 Counts .
5,505,214 4/1996 Collins .

FOREIGN PATENT DOCUMENTS 421623 6/1937 Belgium .

OTHER PUBLICATIONS

PCT/US 97/20967 International Search Report.

*Primary Examiner*—John G. Weiss
*Assistant Examiner*—Charles W. Anderson
*Attorney, Agent, or Firm*—James T. Moore; James E. Schardt; Charles E. B. Glenn

[57] ABSTRACT

Methods and apparatuses for cleaning an electrical lighter are provided. A sleeve, e.g., ceramic or metal, surrounds the heater fixture, and a resistive heating element is in thermal proximity with the sleeve. The resistive heating element is either a dedicated element or the cigarette heating elements. The sleeve serves as a aerosol barrier and condensate accumulator to protect other components. Periodically, e.g., substantially contemporaneously with a battery recharge, the heating element is activated to thermally liberate condensates deposited on the sleeve during smoking and also heats, and thereby cleans, other components. Also, a cleaning element is optionally inserted into the cigarette receptacle of the electrical lighter or placed at the exit thereof to absorb, attract and/or catalytically break down the thermally liberated condensates. The sleeve also directs a desired flow path for drawn air within an electrical lighter toward the cigarette.

69 Claims, 22 Drawing Sheets

METHOD AND APPARATUS FOR USING, CLEANING, AND MAINTAINING ELECTRICAL HEAT SOURCES AND LIGHTERS USEFUL IN SMOKING SYSTEMS AND OTHER APPARATUSES

I. CROSS REFERENCE TO RELATED APPLICATIONS

The present application relates to commonly assigned U.S. patent application Ser. No. 08/380,718, filed Jan. 30, 1995, which in turn is a continuation of patent application Ser. No. 08/118,665, filed Sep. 10, 1993, now U.S. Pat. No. 5,388,594 issued Feb. 14, 1995 and to commonly assigned patent application Ser. No. 07/943,504, filed Sep. 11, 1992, which in turn is a continuation-in-part of patent application Ser. No. 07/666,926, filed Mar. 11, 1991, now abandoned in favor of filewrapper continuation application Ser. No. 08/012,799, filed Feb. 2, 1993, which is now U.S. Pat. No. 5,249,586 issued Oct. 5, 1993.

The present application further relates to commonly assigned, copending U.S. patent applications Ser. No. 08/365,952, filed Dec. 29, 1994, entitled "Aluminum Containing Iron-Base Alloys Useful as Electrical Resistance Heating Elements" (Attorney Docket No. PM 1767), to Ser. No. 08/425,166, filed Apr. 20, 1995, entitled "Cigarette for Electrical Smoking System" (Attorney Docket No. PM 1759A), to Ser. No. 08/425,837, filed Apr. 20, 1995, entitled "Cigarette for Electrical Smoking System" (Attorney Docket No. PM 1759B), Ser. No. 08/426,165, filed Apr. 20, 1995, entitled "Heater for Use in an Electrical Smoking System" (Atty. Docket No. PM 1768), to Ser. No. 08/426,006, filed Apr. 20, 1995, entitled "Iron Aluminide Alloys Useful as Electrical Resistance Heating Elements" (Attorney Docket No. PM 1769), and to Ser. No. 08/483,363, filed Jun. 7, 1995, entitled "Protective and Cigarette Ejection System for an Electrical Lighter" (Attorney Docket No. PM 1778); and to commonly assigned U.S. Pat. No. 5,408,574, issued Apr. 18, 1995, which is a continuation-in-part of commonly assigned U.S. Pat. No. 5,224,498, issued Jul. 6, 1993, which is a continuation-in-part of commonly assigned U.S. Pat. No. 5,093,894 issued Mar. 3, 1992.

All of these referenced and related patents and applications are hereby incorporated by reference in their entireties.

II. BACKGROUND OF THE INVENTION

A. Technical Field of the Invention

The present invention relates to methods and apparatuses for using, cleaning, and maintaining electrical heat sources and lighters useful in electrical smoking systems or the like.

B. Discussion of the Related Art

Previously known conventional lit cigarettes deliver flavor and aroma to the user as a result of combustion of tobacco. A mass of combustible material, primarily tobacco, is oxidized as the result of applied heat with typical combustion temperatures in a conventional cigarette being in excess of 800° C. during puffing.

Heat is drawn through an adjacent mass of tobacco by drawing on the mouth end. During this heating, inefficient oxidation of the combustible material takes place and yields various distillation and pyrolysis products. As these products are drawn through the body of the smoking device toward the mouth of the user, they cool and condense to form the aerosol which gives the consumer the flavor and aroma associated with smoking.

Conventional lit cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

Prior alternatives to the more conventional lit cigarettes include those in which the combustible material itself does not directly provide the flavorants to the aerosol inhaled by the smoker. In these lit cigarettes, a combustible heating element, typically carbonaceous in nature, is combusted to heat air as it is drawn over the heating element and through a zone which contains heat-activated elements that release a flavored aerosol. While this type of lit cigarette produces little or no sidestream smoke, it still generates products of combustion, and once lit it is not adapted to be snuffed for future use in the conventional sense.

In both the more conventional lit cigarettes and lit carbon element heated cigarettes described above combustion takes place during their use. This process naturally gives rise to many by-products as the combusted material breaks down and interacts with the surrounding atmosphere.

Several proposals have been advanced which significantly reduce undesired sidestream smoke while permitting the smoker to suspend smoking of the article for a desired period and then to resume smoking. Commonly assigned U.S. Pat. Nos. 5,093,894; 5,225,498; 5,060,671 and 5,095,921 disclose various electrical resistive heating elements and flavor generating systems which significantly reduce sidestream smoke while permitting the smoker to selectively suspend and reinitiate smoking.

U.S. Pat. No. 5,388,594, issued Feb. 14, 1995, entitled "Electrical Smoking System for Delivering Flavors and Method for Making Same"; U.S. Pat. No. 5,499,636, issued Mar. 19, 1996, entitled "Cigarette for Electrical Smoking System"; U.S. patent application Ser. No. 08/380,718, filed Jan. 30, 1995, entitled "Electrical Smoking System for Delivering Flavors and Method for Making Same" (Attorney Docket No. PM 1697 CON/DIV1); and U.S. patent application Ser. No. 08/426,165, filed Apr. 20, 1995, entitled "Heater for Use in an Electrical Smoking System" (Atty. Docket No. PM 1768) each describe an electrical smoking system including novel electrically powered lighters and novel cigarettes that are adapted to cooperate with the lighters, and each is incorporated herein by reference.

The preferred embodiment of the lighter of U.S. Pat. No. 5,388,594 includes a plurality of metallic heaters disposed in a configuration that slidingly receives a tobacco rod portion of the cigarette. One of the many advantages of such smoking systems is the reusability of the lighter for numerous cigarettes.

As these novel cigarettes are heated by the firing of heaters, aerosol is generated for smoking by the smoker. Some portion of the generated aerosol is not delivered to the smoker and may tend to condense and form condensates on the relatively cooler individual heaters, the heater fixture, electrical connections, electronic components and other components and structures located within the cigarette-receiving cavity and/or subject to contact with the generated aerosol. In addition, portions of the cigarette, especially portions which have been heated and therefore thermally weakened, may cling to surfaces, especially to individual heaters, after the cigarette is removed due to tight tolerances.

Such condensation and/or cigarette remnants, especially if permitted to accumulate, can alter the subjective taste of subsequent cigarettes; can block required airflow passages, especially the passageways communicating with any puff sensitive pressure drop sensor and/or with outside ambient air; can damage sensitive electronic and electrical components; and can result in protrusions, snags, etc. which could adversely affect insertion, registration and removal of cigarettes relative to the heater fixture.

Though not desiring to be bound by theory, it is believed that the condensation is the result of the flow pattern and pressure gradient of ambient air drawn through the cigarette and the current designs of the heater assemblies. The heating of the cigarette tobacco produces aerosols which are then cooled to result in condensation on the surfaces of relatively cooler components.

U.S. Pat. No. 5,388,594, issued Feb. 14, 1995 entitled "Electrical Smoking System for Delivering Flavors and Method for Making Same", and U.S. patent application Ser. No. 08/380,718, filed Jan. 30, 1995 entitled "Electrical Smoking System for Delivering Flavors and Method for Making Same", which are hereby incorporated by reference in their entireties, disclose a heater sleeve which surrounds the cylindrical heater assembly and is exposed to residual aerosols to protect an outer air channel sleeve.

As described, this heater sleeve is discarded after a certain interval, e.g. 30–60 cigarettes, and replaced with a new heater sleeve, necessitating a potentially time consuming and/or inconvenient replacement procedure by the smoker. Also, this removal of a used sleeve and installation of a new sleeve could potentially damage the cigarette heater assembly, which may be delicate.

In addition, it is desirable to couple any cleaning of the electrical lighter with other routine maintenance procedures such as recharging of lighter batteries. For example, it may be desired to perform both cleaning and recharging on a daily basis, preferably substantially contemporaneously. Also, it may be desirable to alert the smoker of the necessity of these functions and/or to establish these functions as prerequisites to operation of the lighter.

Also, it is desirable to degrade any cleaning by-products for aesthetic reasons.

III. OBJECTS OF THE INVENTION

Accordingly, it is an object of the present invention to provide methods and apparatuses for using, cleaning and maintaining heaters and electrical lighters useful in smoking systems.

It is another object of the present invention to provide an indication that cleaning of the heater or lighter is required.

It is a further object of the present invention to provide heating techniques and heating elements for the methods and apparatuses for using, cleaning, and maintaining electrical lighters. Such techniques as contemplated will effectively clean the heating elements and lighter without damaging sensitive components with excessive heat or effluent.

It is yet another object of the present invention to provide methods and apparatuses for cleaning electrical lighters which are relatively simple for the smoker to employ.

It is an additional object of the present invention to provide a method and apparatus for cleaning electrical lighters which is combined with and/or contemporaneous with other routine maintenance procedures such as recharging batteries of the electrical lighter.

It is still another object of the present invention to indicate the status of a cleaning operation for an electrical lighter.

It is a still further object of the present invention to provide a method and apparatus for cleaning electrical lighters which is reusable over the life of an electrical lighter.

It is considered another object of the present invention to provide a desired air flow path within an electrical lighter when in use.

Moreover, it is an object of the present invention to provide a method and apparatus for cleaning electrical lighters which is conveniently powered by the power supply of the electrical lighter.

It is yet another object of the present invention to reduce the escape of released condensates by methods including containment, entrapment, and decomposition by heat, ultraviolet radiation, and catalysis.

It is an object of the present invention to provide a general all purpose tubular micro-scale heater for use in applications requiring controlled heating in a limited space such as the cleaning of a lighter.

It is a further object of the present invention to accomplish the foregoing objects without requiring an additional heating element for the electrical lighter.

It is further object of the present invention to accomplish the foregoing objects simply and in a straightforward manner.

Additional objects and advantages of the present invention are apparent from the drawings and specification which follow.

IV. SUMMARY OF THE INVENTION

The foregoing and additional objects are obtained by methods and apparatuses for cleaning an electrical lighter according to the present invention. A sleeve, e.g., ceramic or metal, surrounds the heater fixture, and a resistive or inductive heating element is in thermal proximity with the sleeve. The resistive heating element is either a dedicated element or can be the cigarette heating elements. The sleeve serves as a aerosol barrier and condensate accumulator to protect other components.

Periodically, e.g., substantially contemporaneously with a battery recharge, the heating element is activated to thermally liberate condensates deposited on the sleeve during smoking. The heating of the sleeve also heats, and thereby cleans, other components. Also, a cleaning element is optionally inserted into the cigarette receptacle of the electrical lighter or placed at the exit thereof to absorb, attract and/or catalytically break down the thermally liberated condensates. A photocatalytic degradation of the liberated condensates may also be used.

The sleeve also directs a desired flow path for drawn air within an electrical lighter toward the cigarette and may have an intermediate layer which reflects heat back to the cigarette receptacle; preventing excessive heating of other components.

Also, the heater assembly herein described finds applications in micro-heater assemblies wherever a controllable pinpoint heat source may be used.

V. BRIEF DESCRIPTION OF THE DRAWINGS

VI. DETAILED DESCRIPTION OF THE PREFERRED EMBODIMENT

Figure 1:
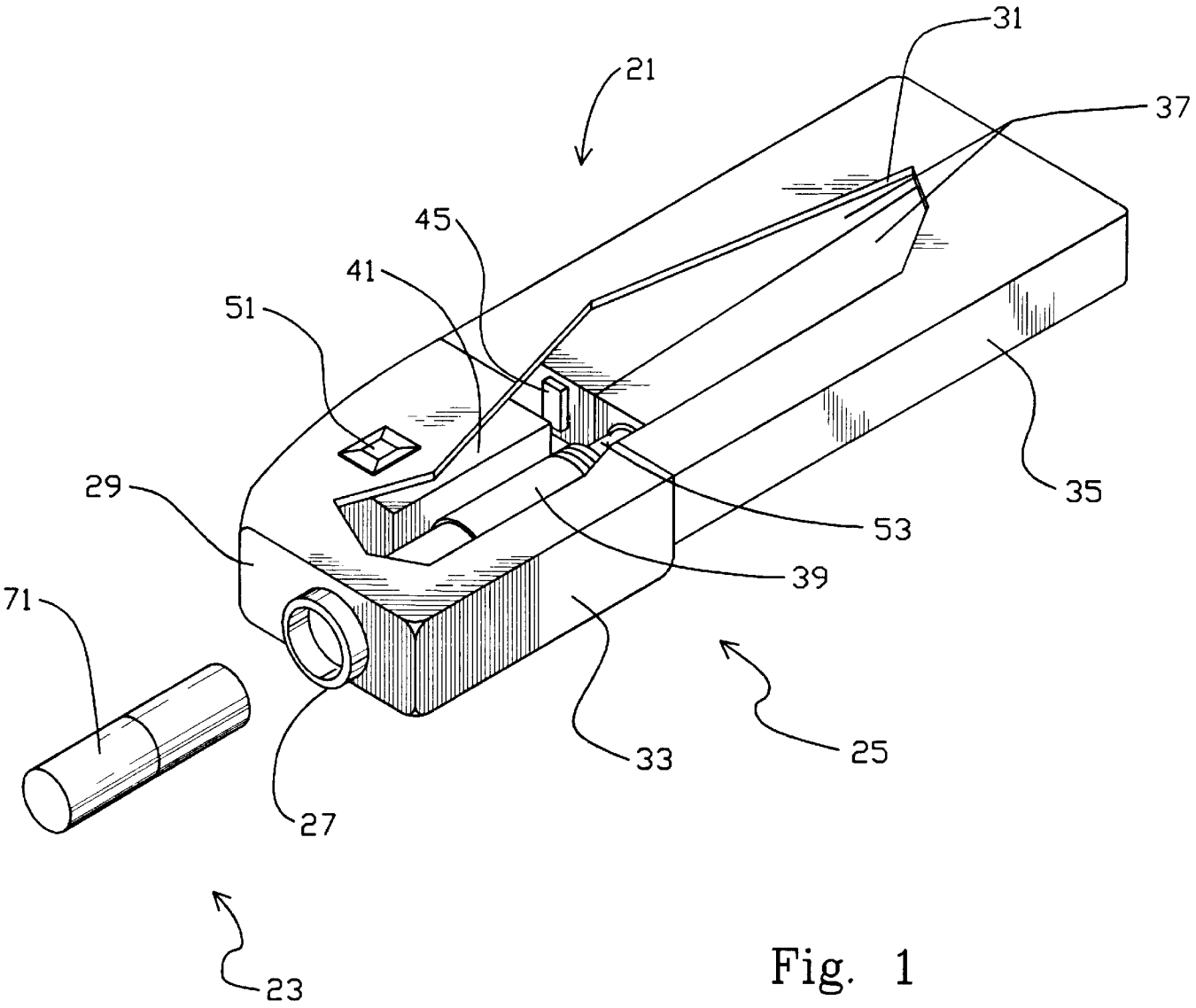
FIG. 1 is a partially exposed perspective view of an electrical lighter employing a method and apparatus according to the present invention for cleaning accumulated condensates.

As the smoking system generally involves several operating systems, to assist in the understanding thereof, this specification has been divided into sections which follow to ease in understanding the nature of the invention; which sections should not be interpreted as anything other than an organizational structure to this written application.

A. The Smoking System Generally

A smoking system 21 according to the present invention is described in greater detail in U.S. Pat. No. 5,388,594 and application Ser. No. 08/380,718, filed Jan. 30, 1995 which are hereby incorporated by reference in their entireties, and is generally seen with reference to FIGS. 1 and 2 of the present application. The present invention is discussed in greater detail with reference to FIGS. 3–15.

The smoking system 21 includes a cylindrical cigarette 23 and a reusable, hand-held lighter 25. The cigarette 23 is adapted to be inserted in and removed from an orifice 27 at a front end 29 of the lighter 25. The smoking system 21 is used in much the same fashion as a conventional cigarette. The cigarette 23 is disposed of after one or more puff cycles. The lighter 25 is preferably disposed of after a greater number of puff cycles than the cigarette 23.

B. The Lighter

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35.

The housing 31 is preferably adapted to fit comfortably in the hand of a smoker and, in a presently preferred embodiment, has overall dimensions of approximately 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor, or more preferably, a battery. In a presently preferred embodiment, the power source is a replaceable, rechargeable battery such as four nickel-cadmium battery cells connected in series with a total, non-loaded voltage of approximately 4.8 to 5.6 volts.

The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery sources and quick-discharging capacitor power sources that are charged by batteries, and is hereby incorporated by reference.

C. The Lighter Heating Elements

Figure 3:
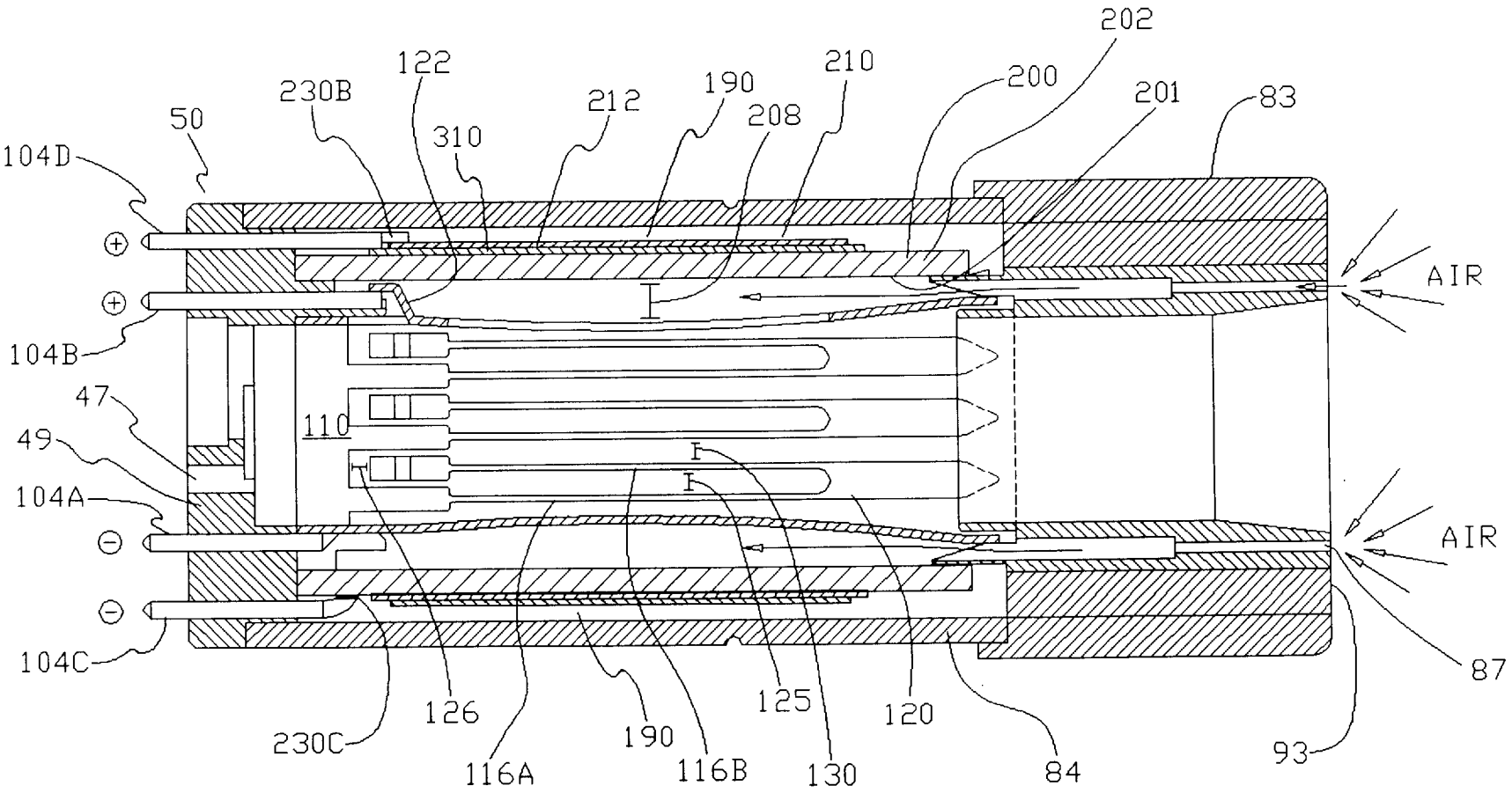
FIG. 3 is a side, cross-sectional view of a heater fixture surrounded by a sleeve and associated heating element according to the present invention.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to cigarette heating elements 120 of the heating fixture 39 are preferably disposed in the front 33 of the lighter. As described in greater detail below, a generally circular, terminal end hub 110 is fixed, e.g., welded, to be disposed within the interior of cigarette heater fixture 39, e.g., is fixed to spacer 49, as shown in FIG. 3.

In the presently preferred embodiment, the heating fixture 39 includes a plurality of radially spaced heating blades 120 supported to extend from the hub, seen in FIG. 3 and described in greater detail below, that are individually energized by the power source 37 under the control of the circuitry 41 to heat a number of, e.g., eight, areas around the periphery of the inserted cigarette 23. Eight heating blades 120 are preferred to develop eight puffs as in a conventional cigarette, and eight cigarette heater elements also lend themselves to electrical control with binary devices. A desired number of puffs can be generated, e.g., any number between 5–16, and preferably 6–10, or more preferably about 8 per inserted cigarette.

The heating elements 120 can comprise any suitable heating element for heating tobacco to evolve tobacco flavors. For example, the heating system can comprise any of the resistance and induction heating systems disclosed in U.S. Pat. No. 5,388,594 and application Ser. No. 08/380,718, filed Jan. 30, 1995; Ser. No. 08/225,120, filed Apr. 8, 1994; Ser. No. 08/224,848, filed Apr. 8, 1994; Ser. No. 08/314,463, filed Sep. 28, 1994 Ser. No. 08/333,470 filed Nov. 2, 1994; Ser. No. 08/370,125, filed Jan. 9, 1995 and Ser. No. 08/426,165, filed Apr. 20, 1995.

D. Heater Control Circuitry

Figure 2:
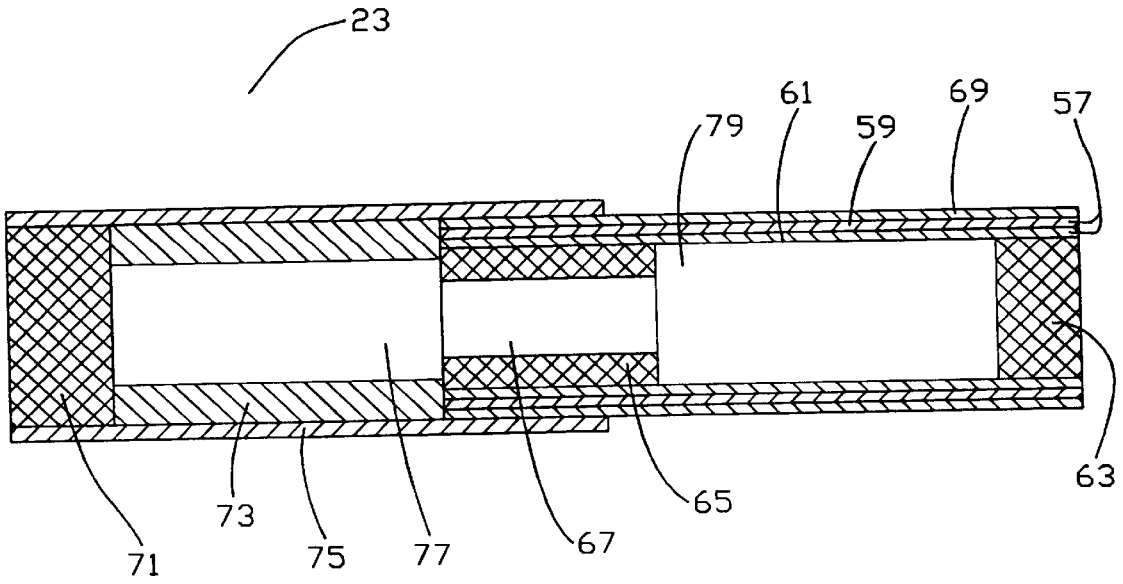
FIG. 2 is a side, cross-sectional view of a cigarette used in conjunction with the electrical lighter of FIG. 1.

The circuitry 41 is preferably energized by a puff sensitive sensor 45, seen in FIG. 1, that is sensitive to pressure drops that occur when a smoker draws on the cigarette 23 and in turn activates an appropriate one of the cigarette heater elements or blades 120 as a result of a change in pressure when a smoker draws on the cigarette 23. The puff sensitive sensor 45 is preferably disposed in the front 33 of the lighter 25 and communicates with a space inside the cigarette heater fixture 39 and near the cigarette 23 through a passageway extending through a spacer and a base of the cigarette heater fixture and, if desired, a puff sensor tube (not shown).

A puff sensitive sensor 45 suitable for use in the smoking system 21 is described in U.S. Pat. No. 5,060,671, the disclosure of which is incorporated by reference.

An indicator 51 is preferably provided on the exterior of the lighter 25, preferably on the front 33, to indicate the number of puffs remaining on a cigarette 23 inserted in the lighter. The indicator 51 preferably includes a seven-segment liquid crystal display. In one embodiment, the indicator 51 displays the digit "8" for use with an eight-puff cigarette when a light beam emitted by a light sensor 53, seen in FIG. 1, is reflected off of the front of a newly inserted cigarette 23 and detected by the light sensor. Other embodiments of indicator 51 are described below.

The light sensor 53 is preferably mounted in an opening in the spacer and the base of the cigarette heater fixture 39. The light sensor 53 provides a signal to the circuitry 41 which, in turn, provides a signal to the indicator 51. For example, the display of the digit "8" on the indicator 51 reflects that the preferred eight puffs provided on each cigarette 23 are available, i.e., none of the heaters have been activated to heat the new cigarette. After the cigarette 23 is fully smoked, the indicator displays the digit "0". When the cigarette 23 is removed from the lighter 25, the light sensor 53 does not detect the presence of a cigarette 23 and the indicator 51 is turned off.

The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEX Technology, Inc., 1215 West Crosby Road, Carrollton, Tex. 75006.

As one of several possible alternatives to using the above-noted light sensor 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry, puff sensitive sensors, and indicators useful with the smoking system 21 of the present invention are described in U.S. Pat. No. 5,060,671 and U.S. patent application Ser. Nos. 07/943,504 and 08/380,718, which are incorporated by reference in their entireties. The passageway and the opening 50 in the spacer and the cigarette heater fixture base are preferably air-tight during smoking.

E. The Preferred Cigarette

A presently preferred cigarette 23 for use with the smoking system 21 is described and shown in greater detail in U.S. Pat. No. 5,388,594 and U.S. patent application Ser. Nos. 08/380,718, filed Jan. 30, 1995; 08/425,166, filed Apr. 20, 1995; and 08/425,837, filed Apr. 20, 1995, which are hereby incorporated by reference in their entireties, although the cigarette or other tobacco format may be in any desired form capable of generating a flavored tobacco response for delivery to a smoker when the cigarette is heated by the cigarette heating elements 120.

F. System Assembly and Wiring

The cigarette heater fixture is disposed in the orifice 27 in the lighter 25. The cigarette 23 is inserted, optional back-flow filter 63 first, in the orifice 27 of lighter 25 into a substantially cylindrical space of the cigarette heater fixture 39 defined by a ring-shaped cap 83 having an open end for receiving the cigarette, a cylindrical air channel sleeve 87 (if employed); passageway 48 (if employed); an outer sleeve 84, a heater assembly including the heater blades 120, an electrically conductive pin or common lead 104A, which serves as a common lead for the heater elements of the heater assembly, electrically conductive positive pins or leads 104B, and the spacer.

The bottom inner surface 81 of the spacer 49 stops the cigarette 23 in a desired position in the cigarette heater fixture 39 such that the heater blades 120 are disposed adjacent the cavity 79 in the cigarette, and in a preferred embodiment are disposed as described in Ser. No. 08/425,166, filed Apr. 20, 1995 and Ser. No. 08/425,837, filed Apr. 20, 1995, which are incorporated by reference in their entireties.

Substantially all of the cigarette heater fixture 39 is disposed inside and secured in position by a snug fit with the housing 31 of the front 33 of the lighter 25. A forward edge 93 of the cap 83 is preferably disposed at or extending slightly outside the first end 29 of the lighter 25 and preferably includes an internally beveled or rounded portion to facilitate guiding the cigarette 23 into and out of the heater fixture 39. The pins 104A and 104B are preferably received in corresponding sockets (not shown), thereby providing support for the cigarette heater fixture 39 in the lighter 25, and conductors or printed circuits lead from the socket to the various electrical elements.

Other pins can provide additional support to strengthen the pin assembly 91. The pins 104A and 104B can comprise any suitable material and preferably comprise tinned phosphorus bronze. The passageway 47 in the spacer 49 and the base 50 communicates with the puff sensitive sensor 45 and the light sensor 53 senses the presence or absence of a cigarette 23 in the lighter 25.

Each blade 120 forms a resistive heater element in the depicted embodiment. More specifically, a first end of first blade section 116A is electrically connected to the negative terminal of the power supply, and more specifically is an integral extension of hub 110 or is mechanically and electrically connected to hub 110, which in turn is electrically and mechanically connected to negative terminal pin 104A via tack welding or another technique such as brazing or soldering.

Preferably, two negative terminal pins 104A are used to provide a balanced support since the negative and positive connections also serve to mechanically support the heaters. The hub 110 thus functions as an electrical common for all of the heater blades 120. In any of the embodiments, the negative connection for each heater blade 120 can be made individually by, e.g., an appropriate negative contact deposited on an end of the heater opposite the respective positive contact areas 122. A respective positive connection for each heater blade 120 is made at connecting end section 122 of the second blade section 116B as discussed in Ser. No. 08/426,165, filed Apr. 20, 1995.

G. Preferred and Alternate Heater Elements

Other cigarette heaters are alternatively employed such as the serpentine shapes, as described more fully in commonly assigned U.S. Pat. No. 5,388,594 and application Ser. Nos. 08/380,718, filed Jan. 30, 1995 and 08/426,165, filed Apr. 20, 1995. For example, both first leg 116A and second leg 116B are serpentine shaped. The serpentine shapes of legs 116A and 116B are parallel such that the legs are evenly spaced and gap 125 is also serpentine-shaped. Such a serpentine shape increases the blade perimeter and aerosol generation and also improves the aerosol entrainment.

H. Creation of a Proper Air Flow Path for Taste Uniformity

It has been found that a primarily transverse or radial air flow relative to the inserted cigarette results in a more desirable aerosol flow radially inward away from a pulsed cigarette heater. The gaps 125, 126 and 130 provide pathways for air to be drawn into contact with the inserted cigarettes. Additional air passages are provided to optimize the transverse air flow by perforating sections of the cigarette heater blades.

The heater assembly is electrically and mechanically fixed at one end via the welding of pin(s) 104A to hub 110 and of pins 104B to ends 122. Pins 104A and 104B are preferably pre-molded into a plastic hub, or otherwise connected thereto, preferably in such a manner so as to minimize air leakage. Preferably, this fixed end is opposite the insertion opening.

I. Lighter and Heater Assembly Control Logic

It is noted that the electrical control circuitry 41 includes a logic circuit, which is an application specific integrated circuit or ASIC, the puff sensitive sensor 45 for detecting that a smoker is drawing on a cigarette 23, the light sensor 53 for detecting insertion of a cigarette in the lighter 25, the LCD indicator 51, a power source 37, and a timing network, as described in greater detail in U.S. Pat. No. 5,388,594 and Ser. No. 08/380,718, filed Jan. 30, 1995, which are hereby incorporated by reference in their entireties. The logic circuit is any conventional circuit capable of implementing the functions discussed herein.

A field-programmable gate array (e.g., a type ACTEL A1010A FPGA PL44C, available from Actel Corporation, Sunnyvale, Calif.) can be programmed to perform the digital logic functions with analog functions performed by other components, while an ASIC is required to perform both analog and digital functions in one component. Features of control circuitry and logic circuitry similar to the control circuit 41 and logic circuit of the present invention are further disclosed, for example, in U.S. Pat. No. 5,060,671 and U.S. patent application Ser. No. 07/943,504, the disclosures of which are incorporated by reference.

It is further noted that in the preferred embodiment, eight individual heater blades 120 are connected to the power source 37 through corresponding field effect transistor (FET) heater switches. Individual ones of the heater switches will turn on under control of the logic circuit through terminals, respectively. The logic circuit provides signals for activating and deactivating particular ones of the heater switches to activate and deactivate the corresponding ones of the heaters.

During operation, a cigarette 23 is inserted in the lighter 25, and the presence of the cigarette is detected by the light sensor 53. The light sensor 53 sends a signal to the logic circuit. The logic circuit ascertains whether the power source 37 is charged or whether there is low voltage. If, after insertion of a cigarette 23 in the lighter 25, the logic circuit detects that the voltage of the power source is low, the indicator 51 blinks and further operation of the lighter will be blocked until the power source is recharged or replaced. Voltage of the power source 37 is also monitored during firing of the heater blades 120 and the firing of the heater blades is interrupted if the voltage drops below a predetermined value.

If the power source 37 is charged and voltage is sufficient, the logic circuit sends a signal through to the puff sensor 45 to determine whether a smoker is drawing on the cigarette 23. At the same time, the logic circuit sends a signal to the indicator 51 so that the LCD will display, e.g., the digit "8" or the cigarette icon, reflecting that there are eight puffs available.

When the logic circuit receives a signal from the puff-sensitive sensor 45 that a sustained pressure drop or air flow has been detected, the logic circuit locks out the light sensor 53 during puffing to conserve power. The logic circuit sends a signal to the timer network to activate the constant Joules energy control timer. The logic circuit also determines, by a downcount means, which one of the eight heater elements is due to be heated and sends a signal through an appropriate terminal to turn an appropriate one of the FET heater switches ON. The appropriate heater blade 120 stays on until the control timer logic determines that a prescribed heater energy has been drawn from the power source.

When the timer network sends a signal to the logic circuit 195 indicating that the timer has stopped running, the particular ON FET heater switch is turned OFF, thereby removing power from the heater element. The logic circuit also downcounts and sends a signal to the indicator 51 so that the indicator will display that one less puff is remaining (i.e., "7", after the first puff). When the smoker next puffs on the cigarette 23, the logic circuit will turn ON another predetermined one of the FET heater switches, thereby supplying power to another predetermined one of the heater elements.

The process will be repeated until the indicator 51 displays "0", meaning that there are no more puffs remaining on the cigarette 23. When the cigarette 23 is removed from the lighter 25, the light sensor 53 indicates that a cigarette is not present, and the logic circuit is reset.

In one embodiment, at the cessation of puffing, the FET shuts off the heating element to prevent the unwanted generation of excess aerosol.

Other features, such as those described in U.S. patent application Ser. No. 07/943,504, which is incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 37 has time to recover.

Another disabling feature includes means for disabling the heater blades 120 if an unauthorized cigarette or other product is inserted in the heater fixture 39. For example, the cigarette 23 might be provided with an identifying characteristic that the lighter 25 must recognize before the heater blades 120 are energized.

VII. THE CONDENSATE PROBLEM

During smoking, some of the evolved flavors not drawn to the smoker continue to evolve from the cigarette, e.g., via the entrainment gaps, and would, in the absence of the present invention, tend to condense eventually on internal components of the lighter such as air channel sleeve 87 (if employed); passageway 48 (if employed); outer sleeve 84; the heater assembly including the heater blades 120; common pin or lead 104A; positive pins or leads 104B; the spacer 49, especially the bottom inner surface 81 of the spacer; base 50; and the passageway 47 in the spacer and the base 50 communicating with the puff sensitive sensor 45, all of which are relatively cooler than the cigarette heating elements 120, and on the cigarette heating elements 120 themselves with each generated puff, since the exit of aerosol from the lighter is substantially impeded by both the inserted cigarette and the general air tightness of the lighter, as discussed in the related U.S. Pat. No. 5,388,594 and application Ser. No. 08/380,718, filed Jan. 30, 1995.

As the cigarette heating elements 120 are fired to evolve flavors and generate a subsequent puff, condensates on the cigarette heating elements 120 from the previous puff(s) are usually dissipated by this heating. As discussed in greater detail below, the cigarette heating elements 120 can be further cleaned by heat transfer from the heated ceramic sleeve or by being heated individually or en masse with no cigarette present.

However, condensates continue to accumulate on the other above-identified inner components of the lighter. At some point, e.g., after smoking approximately 2 to 10 packs (assuming, e.g., 8 firings, and thus 8 puffs per cigarette, and 20 cigarettes per pack), this condensate build-up should be cleaned to prevent adverse effects on the subjective taste of subsequent cigarettes; blockage of required airflow passages, especially the passageway 47 in the spacer, passageway 48 (if employed), and the base 50 communicating with the puff sensitive sensor 45 and/or with outside ambient air; damage to sensitive electronic and electrical components; and protrusions, snags, etc. which could adversely affect insertion, registration and removal of cigarettes relative to the heater fixture.

VIII. MAINTENANCE OF THE HEATER AND LIGHTER APPARATUSES

Referring to FIGS. 3–13, exemplary cleaning apparatuses 190 and associated cleaning methods according to the present invention are shown and described in greater detail. The various described devices and methods can be combined in any manner to achieve desired functions.

A. The Sleeve

Cleaning apparatus 190 comprises a cylindrical, preferably swaged, sleeve 200 concentrically surrounding the cigarette heater fixture defined by blades 120, and thus concentrically surrounds inserted cigarette 23. In one embodiment, cleaning apparatus 190 further comprises an associated heating element 210.

As discussed in greater detail below, the heater element 210 transfers heat primarily via conduction to the inner surface 201 of sleeve 200 and indirectly from this heated inner surface 201 primarily via convection and radiation to other component surfaces to thermally liberate condensates deposited thereon.

Alternatively, sleeve 200 is heated by the cigarette heaters 120, as discussed in greater detail below with reference to FIGS. 9 and 10, or by a heater which is external to the lighter, e.g., located in the recharger unit discussed below, and which is brought into thermal proximity with the sleeve 200 during the combined cleaning and recharging operation discussed below.

In all embodiments, an adequate concentric gap 208, e.g., approximately 0.010 to approximately 0.120 inches, e.g., approximately 0.040 to approximately 0.100 inches, preferably separates inner surface 201 of sleeve 200 from the cigarette heater blades 120. If concentric gap 208 is too large, condensates will tend to accumulate undesirably on component surfaces other than the sleeve inner surface 201.

In addition, too large of a concentric gap 208 results in inefficient heat transfer to the other component surfaces since convection and radiation efficiency are exponentially governed by the distance between the heated sleeve inner surface 201.

Conversely, if concentric gap 208 is too small, a smaller air passageway will be defined between sleeve inner surface 201 and the inserted cigarette 23, possibly resulting in an inadequate supply of air being entrained by the smoker and in potentially degraded delivery to the smoker.

Cylindrical sleeve 200 can define any geometrical shape that comprises a surface for condensing, collecting and/or accumulating at least some of the aerosols not delivered to a smoker. For example, inner surface 201 defines a substantially cylindrical inner surface for condensing at least some of the aerosols not delivered to a smoker. A cylindrical sleeve is employed for relative ease of fabrication, relative ease of implementation into lighter 25, and to define cylindrical inner surface 201 which surrounds the cylindrical cigarette 23 to form a condensate accumulator.

Cylindrical sleeve 200 preferably comprises a material which forms a suitable aerosol barrier between the inserted cigarette and other components, in particular relatively outer sleeve 84. A ceramic, e.g, alumina, e.g., an approximately 94% alumina commercially available from Kyocera America, Co. of San Diego, Calif. or Coors Technical Ceramics Co. of Oak Ridge, Tenn., or metal, e.g., Haynes® Alloy No. 214, a nickel-based alloy containing 16.0 percent chromium, 3.0 percent iron, 4.5 percent aluminum, traces of yttrium and the remainder (approximately 75 percent) being understood to be nickel, commercially available from Haynes International of Kokomo, Ind., preferably coated with a ceramic encapsulating and insulting coating, can be employed for sleeve 200.

In addition, the material of heater sleeve 200 should be durable and able to withstand the heating cycle described below for an acceptable period, e.g., the life of the electrical lighter, e.g., approximately 6 to 18 months. Heating element 210 and sleeve 200 can be formed from the same material in any of the discussed embodiments if appropriate electrical insulation is provided. In one embodiment, sleeve 200 is contoured to match the inner bowing of the blades 120, i.e., is substantially parallel therewith, to obtain a relatively quicker and more even application of heat to sleeve 200 if blades 120 are employed as discussed below to heat sleeve 200.

The inner surface 201 of the barrier sleeve 200 facing and concentrically surrounding the cigarette heater fixture 39, being relatively cooler than the heated cigarette heater elements 120, functions as a condensation surface and condensate accumulator for a large portion of those generated tobacco flavors which are not delivered to the smoker and which tend to flow radially outward from cigarette 23. Sleeve inner surface 201 is a preferred condensate surface relative to these other component surfaces since sleeve inner surface 201 circumferentially surrounds the inserted cigarette 23 to trap evolving aerosol, is dedicated to function as a condensate surface and is suited to a dedicated heating element.

In a particularly preferred embodiment, a heat-reflective intermediate sleeve increases the efficiency of the heating of the surfaces which require cleaning by reducing the heat transferred to the outer sleeve by radiation. This also reduces the rate of increase in temperature of and the peak temperature of the outer sleeve.

Figure 9A:
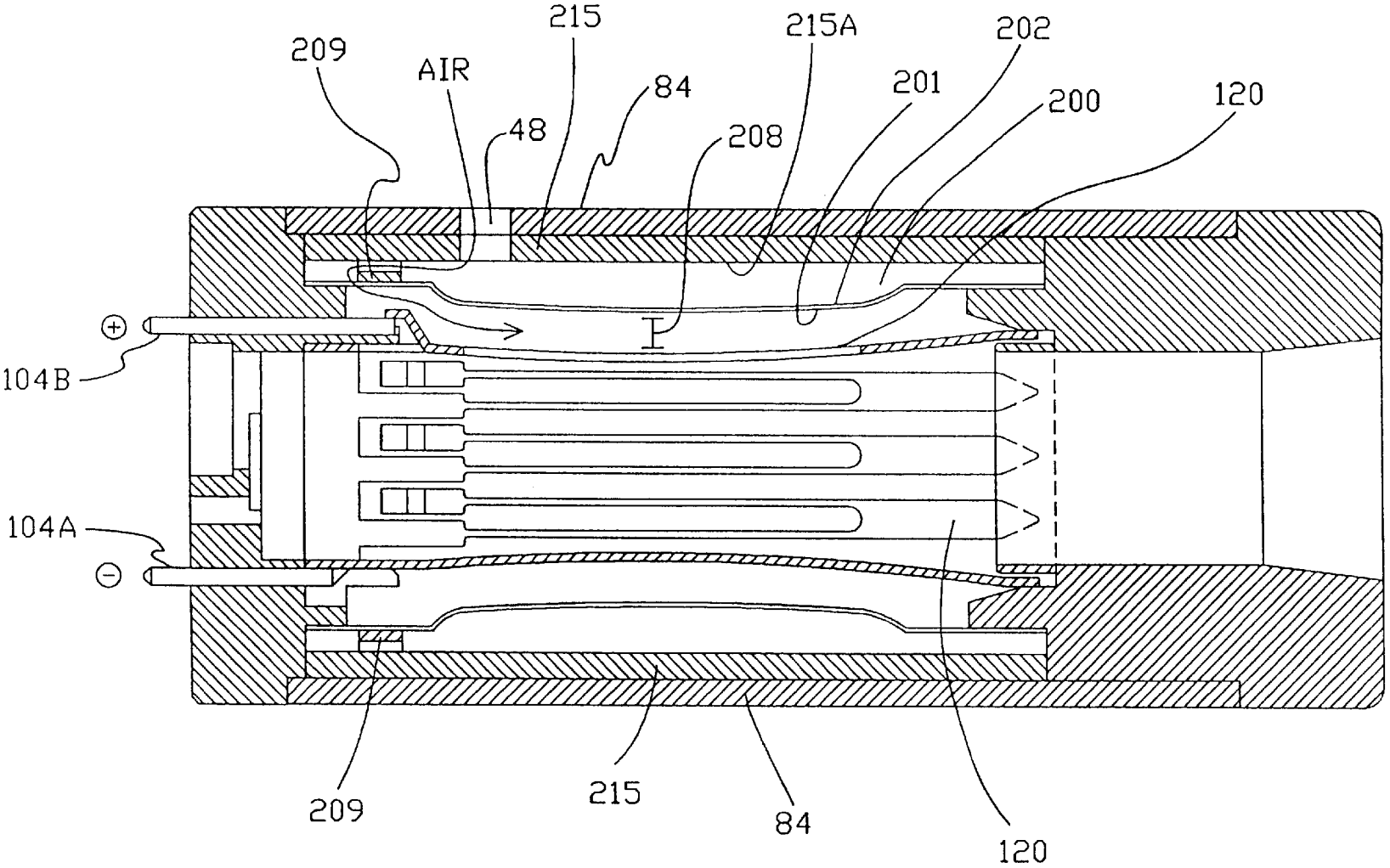
FIG. 9A is a side, cross-sectional view of a heater fixture surrounded by a condensation sleeve and a heat reflective sleeve according to the present invention.

As may be seen by reference to FIG. 9A, inner sleeve 201 may be heated by the firing of heaters 120 (collectively) to reach a peak temperature. Intermediate tube 215A fits between the inner sleeve and outer sleeve 84. The intermediate tube may be made of any of a wide variety of reflective high temperature materials which contain heat, and may be selected by one of skill in the art having regard for this disclosure, e.g. an aluminum or gold reflective metallic coating or sheath may be used.

If employed, the heating element 210 in any embodiment should be suitable to be heated to an adequately high temperature to heat, primarily via conduction, the cylindrical sleeve 200, and more particularly sleeve inner surface 201, to preferred operating temperatures of approximately 150° C. to approximately 750° C., e.g., approximately 300° C. to approximately 600° C., e.g., approximately 400° C. to approximately 500° C., e.g., approximately 450° C., as discussed below.

As best seen in FIGS. 3–8, the heating element 210 is in intimate thermal contact with the cylindrical sleeve 200. Alternatively, sleeve 200 is electrically resistive, e.g., a metal as described below, and is directly resistively heated. Alternatively, heating element 210 is located within or through sleeve 200 or on inner surface 201, e.g., heating element comprises a resistively heated wire or wires located within or through sleeve 200.

Figure 4:
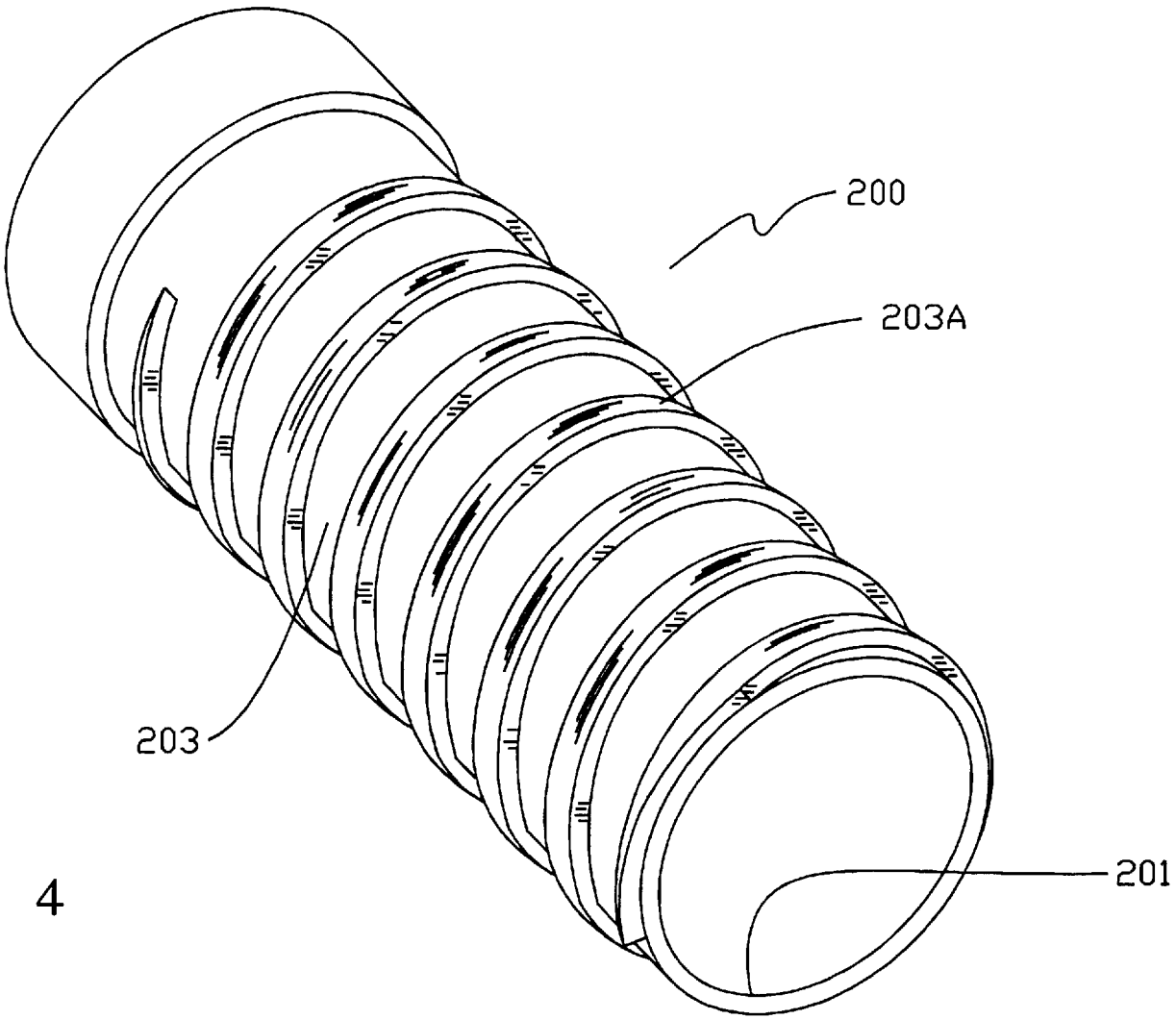
FIG. 4 is an isometric view of a sleeve and associated heating element having a single spiral according to the present invention.

In one embodiment, heating element 210 comprises a resistance heating wire or wires contacting the outer surface 202 of sleeve 200. Turns of wire 212 are insulated from one another to prevent short circuits. For example, the resistance heating wire or wires can be wrapped around or alternatively within ceramic or metal sleeve 200 in a spiral fashion and preferably cradled in at least one helical groove 203 formed in the sleeve outer surface 202 and defined by threads 203A, as shown in FIG. 4. In this embodiment, helical groove 203 is a single spiral such that terminal ends of the resistance wire are located at opposite ends of sleeve 200 for connection to an appropriate power source and control logic, as discussed below.

A preferred configuration will now be described with particular reference to FIGS. 3–7. The sleeve heating element 210 comprises a laminate on a metal sleeve 200, similar to the cigarette heaters described in Ser. No. 08/224,848, filed Apr. 8, 1994 and Ser. No. 08/370,125, filed Jan. 9, 1995, which are hereby incorporated by reference in their entireties. In the present invention, a ceramic layer 310 and a heater layer 210, as best shown in FIG. 6, are deposited on a sleeve 200 having the at least one spiral groove 203 defined by "hills" or spiral thread 203A, as shown in FIG. 4. More specifically, the sleeve outer surface 202 is first coated with a ceramic insulator 310 and then resistive heater layer 210 is applied, and preferably thermally sprayed, to ceramic insulator 310 as described below.

Figure 5:
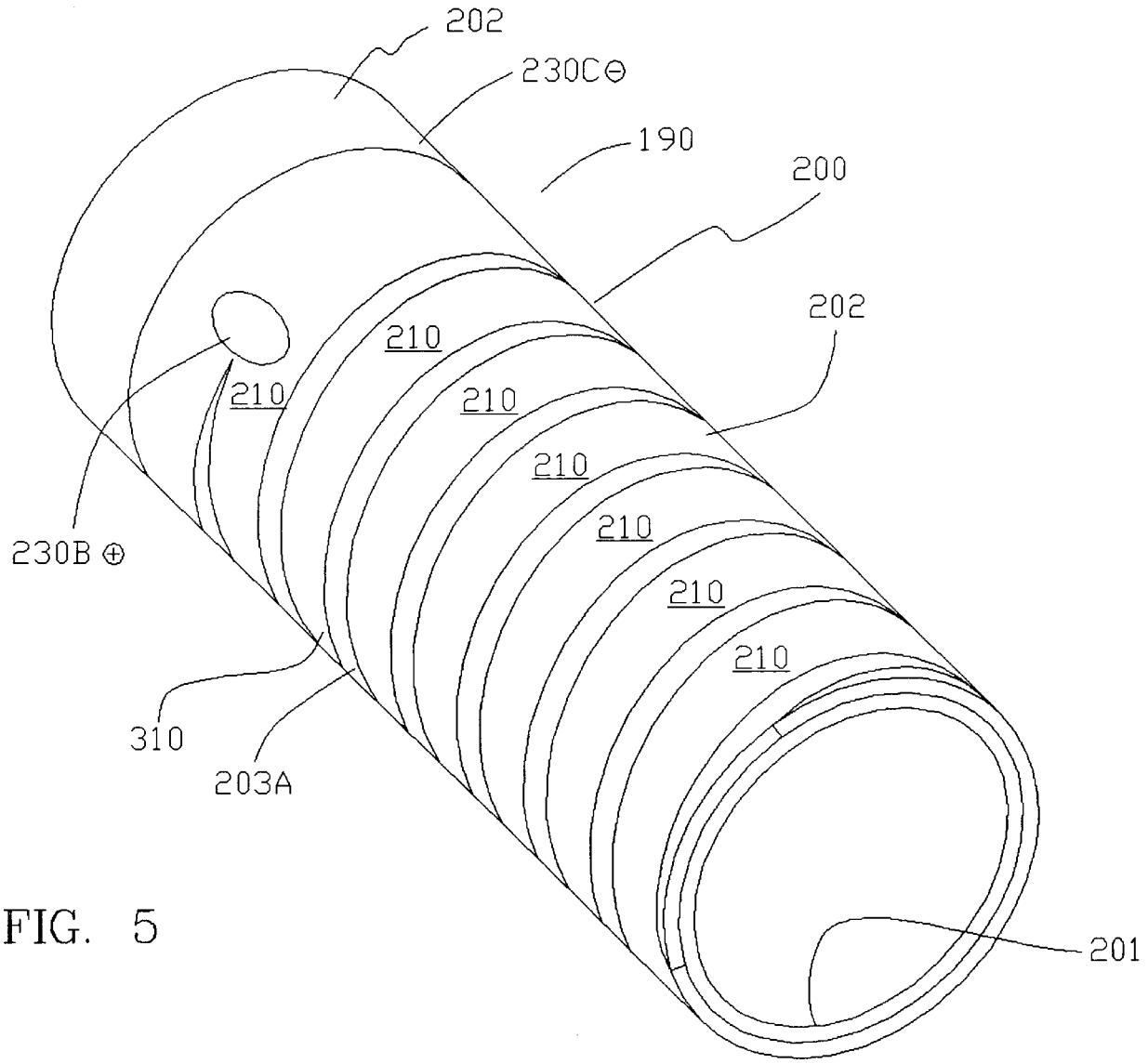
FIG. 5 is an isometric view of a coated sleeve according to the present invention.
Figure 6:
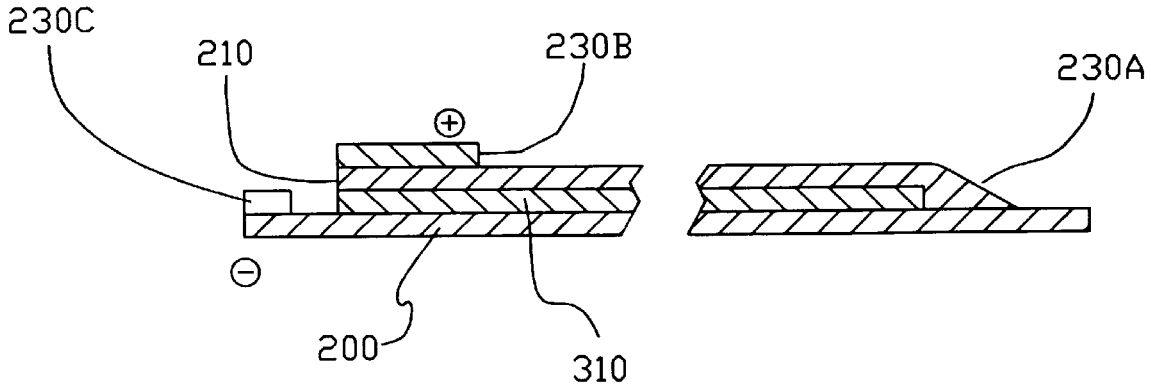
FIG. 6 is a side, cross-sectional view of a sleeve heating element according to the present invention employing a laminate of a electrically conductive sleeve, an electrical insulator, and a resistive heating element.

Next, the coated sleeve is ground to remove heater layer 210 and, if desired, ceramic layer 310 from spiral thread 203A so that ceramic layer 310 and heater layer 210 rest in groove 203, as shown in FIG. 5. A continuous spiral resistive path is accordingly defined wherein each turn of the spiralling heater layer 210 is electrically isolated from adjacent turn(s) via the interposed turns of ground thread 203A which are coated with insulating ceramic layer 310 except for the optionally ground tops or peaks.

The spiral thread 203A is preferably formed by stamping a sheet of appropriate metal with diagonal depressions or other appropriate patterns and then rolling the stamped sheet to form a sleeve 200 with the desired spiral thread 203A and spiral groove 203 on sleeve outer surface 202. This stamping and rolling also forms an inner spiral thread or channel (not shown) and associated inner spiral groove (not shown) located on sleeve inner surface 201. The inner spiral thread corresponds to spiral groove 203, and the inner spiral groove corresponds to spiral thread 203A located on sleeve outer surface 202.

Accordingly, air is drawn by a smoker into the lighter housing, and specifically is drawn between sleeve inner surface 201 and the outer surface of cigarette 23 as described below, and the defined inner spiral groove on sleeve inner surface 201 serves to direct or channel air drawn by a smoker into the lighter housing around the inserted cigarette 23 in a spiral course, thereby advantageously supplying drawn air to various circumferential locations of the cigarette to result in a more uniform air distribution and a more thorough mixing with the generated flavors in the lighter housing.

A smooth cylindrical surface surrounding the inserted cigarette 23 results in air, drawn by a smoker into the lighter housing via front holes, being directed in a more streamlined manner and a less thorough mixing in the lighter housing.

Figure 7:
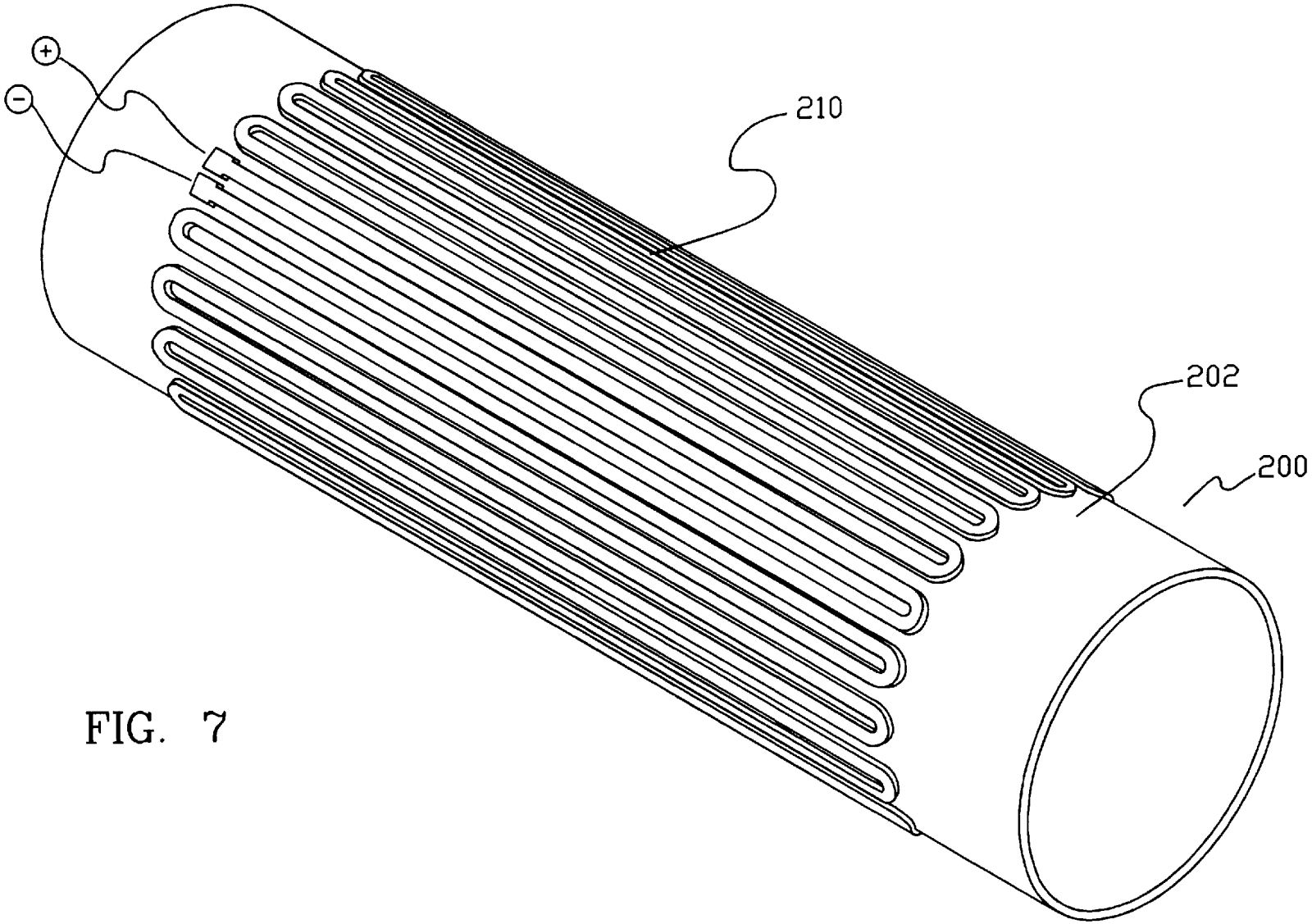
FIG. 7 is an isometric view of a sleeve and associated heating element pattern according to the present invention.

Alternatively, the sheet or formed sleeve is masked prior to the application of the ceramic layer 310 and heater layer 210 to form any desired pattern such as the pattern depicted in FIG. 7. Regardless of whether grinding, masking and/or a conventional technique is employed to define a desired pattern for ceramic layer 310 and heater layer 210, the defined pattern preferably comprises a continuous resistive path having multiple segments isolated from one another to prevent short circuits. Optionally, an additional electrically insulating coating is applied to the defined pattern of ceramic layer 310 and heater layer 210 to prevent short circuits.

A preferred sleeve heater 210 and electrical connection is shown in FIGS. 3 and 6. This electrical connection is preferably employed with the spiral configuration described above with reference to FIGS. 4 and 5 or with any other desired pattern, and is particularly preferred for resistance patterns defined by heater layer 210 having terminal ends at opposite ends of the sleeve outer surface 202. As best seen in FIG. 6, an end of the deposited sleeve heater element 210 is in intimate electrical contact with the underlying metal sleeve 200 at contact area 230A and the remainder of sleeve heating element 210 overlies the ceramic insulating layer 310. Plasma coating of the resistive sleeve heating element 210 to the metal sleeve 200 provides a strong contact.

An electrical common is formed by the electrically conducting metal sleeve 200 which is connected (1) at one end of lighter 25, e.g., the proximal end nearest to the cigarette insertion opening, to the negative terminal end of sleeve heating element 210 via contact area 230A and (2) at the opposite end of lighter 25, e.g., the distal end farthest from the cigarette insertion opening, to the power source via pin 104C and contact area 230C, as shown in FIGS. 3 and 6.

The positive connection is made via pin 104D to contact area 230B which is also located at the distal end of the lighter opening. Sleeve 200 thus functions as a common lead, permitting both contact pins 104C and 104D to be located in a relatively more secure position away from the cigarette insertion opening of lighter 25. Accordingly, a resistive heating circuit for the sleeve 200 is formed which is connected to an appropriate power supply and control logic.

Sleeve 200 preferably comprises a metal substrate in the form of a cylindrical tube since metal is more flexible for fabrication, has better loading tolerances than a ceramic and, as discussed below, is electrically conductive. The metal selected for the substrate is mechanically strong to be fabricated as described below and is a thermally stable metal or alloy.

A ceramic layer 310 is deposited on the metal sleeve 200 to electrically insulate a subsequently applied sleeve heating element 210 from the metal sleeve except for an exposed negative contact or common 230A. Preferably, the surface roughness of the metal sleeve outer surface 202 is increased to provide better adhesion with the deposited ceramic layer 310.

The adequately thick outer surface 202 is first roughened by an appropriate technique such as grit blasting and then a bond coat is applied. The heating element 210 having a thickness of, e.g., approximately 0.1 to 10 mils, or approximately 0.5–6 mils, and more preferably 1–3 mils, is deposited next. Significant thermal expansion mismatch between insulator 310 and both the metal sleeve 200 and heater layer 210 possibly leading to delamination should be avoided.

A material having a high electrical conductivity, e.g., of nickel, nickel alloys, copper, or aluminum, is sprayed on heater element 210 and the sleeve substrate to form respective contact areas 230B and 230C and then leads, e.g., pins 104D and 104C, are affixed, e.g., by welding, brazing or soldering, as discussed. The material can be integrally formed to leads or soldered, and preferably silver soldered, thereto in lieu of the connecting pins. The high conductive material makes the underlying area less resistive and permits the leads to be more easily added as discussed.

The metal sleeve 200 can be made from an alloy in the form of a sheet, rod or bar, e.g., by drawing. Examples of appropriate metals include NiCr alloys, Haynes® 214 alloy (Haynes® Alloy No. 214, a nickel-based alloy containing 16.0 percent chromium, 3.0 percent iron 4.5 percent aluminum, traces of yttrium and the remainder (approximately 75 percent) being nickel, commercially available from Haynes International of Kokomo, Ind.) and Inconel 625 alloy sheet. Preferably, the metal sleeve is constructed from a nickel aluminide ($Ni_3Al$) alloy, another alloy of nickel and iron or an iron aluminide alloy ($Fe_3Al$) could be employed, as discussed above.

The ceramic layer 310 preferably has a relatively high dielectric constant. Any appropriate electrical insulator can be employed such as alumina, zirconia, mullite, cordierite, spinel, forsterite, combinations thereof, etc. Preferably, zirconia or another ceramic is employed which is thermally stable and having a thermal coefficient of expansion which closely matches that of the underlying metal sleeve to avoid differences in expansion and contraction rates during heating and cooling, thereby avoiding cracks and/or delaminations during operation.

The ceramic layer remains physically and chemically stable as the heating element 210 is heated. A thickness of, e.g., approximately 0.1 to 10 mils, or approximately 0.5–6 mils, and more preferably 1–3 mils, is preferred for the electrical insulator which is a ceramic such as zirconia, and particularly a partially-stabilized, zirconia with approximately 20%, and more preferably 8%, yttria, thermally sprayed, by plasma coating if the surface is adequately rough, onto the tube which preferably is rotated during this deposition. Preferably, the tube is spun a number of times during coating to apply a proper coating.

The bond coat is a thin, e.g., 0.1 to 5 mil, and preferably 0.5 to 1.0 mil layer of a metallic coating such as FeCrAlY, NiCrAlY, NiCr, NiAl or $Ni_3Al$ and provides good bond interface between the roughened metal sleeve outer surface 202 and the subsequently applied ceramic layer 310.

Other deposition techniques are alternatively employed in addition to thermal spraying, and more particularly plasma spraying. For example, physical vapor deposition, chemical vapor deposition, thick film technology with screen printing of a dielectric paste and sintering, a sol-gel technique wherein a sol-gel is applied and then heated to form a solid, and chemical deposition followed by heating. A chemical type of bonding is preferred for bonding strength.

This chemical bonding is achieved by heating the ceramic layer, or ceramic precursor, with the metal outer surface 202 at a relatively high temperature. Alternatively, the metal sleeve 200 is heated at a high temperature to form an oxide layer on the surface which performs similarly to the ceramic layer.

Any appropriate metal, compound, or alloy, with or without intermetallic/ceramic additives, can be employed for heating element 210, in a powder form if required by the deposition technique. More specifically, an approximately 0.1 to 5 mil layer of an electrically resistive material such as the above discussed materials, e.g., NiCr, $Ni_3Al$, NiAl, $Fe_3Al$ or FeCrAlY, is deposited by any known thermal spraying technique such as plasma coating or HVOF (High Velocity Oxy Fuel).

The resistivity of the resistive material may be adjusted with the addition of suitable ceramics or by adjusting the oxidation level of the metal during plasma or HVOF spraying. Thin film techniques, e.g., CVD or PVD, can be used if the surface roughness of the ceramic layer 310, comprised of relatively large ceramic particles compared to the heater material, is smoothed by, e.g., diamond grinding to a surface roughness between 135 to 160 micro-inches Ra, with an average of 145 micro-inches Ra. With this technique a thinner layer of metal is required, resulting in a desired lower mass heater. However, the process is slower.

The heaters can be deposited as the ceramic-coated tube is spun. Alternatively, heating element 210 can be platinum formed onto ceramic layer 310 or onto ceramic sleeve 200 as described in commonly assigned, copending application Ser. No. 08/314,463, filed Sep. 28, 1994.

Since a high resistance is a desired property for electrical heating, thermal spraying is preferred to provide resistive heater layer 210. It can be sprayed using a variety of thermal spraying techniques. A pre-alloyed $Ni_3Al$, a mechanically alloyed $Ni_3Al$, or a powder of Ni and Al in the proper ratio can be used. A pre-heating step is needed if mechanically alloyed $Ni_3Al$ or if Ni and Al powders are used for spraying applications.

Temperature and time for pre-heating will depend on the thermal spray gun parameters and can be adjusted to fall in the range of 600° C. to 1000° C. Particle sizes and size distributions are important to form $Ni_3Al$ if a pre-alloyed $Ni_3Al$ is not used. For the purposes of a resistor, a composition of NiAl can be used.

Several elements can be used as additions to the $Ni_3Al$ alloys. B and Si are the principal additions to the alloy for heater layer 210. B is thought to enhance grain boundary strength and is most effective when the $Ni_3Al$ is nickel rich, e.g., Al≦24 atomic percent. Si is not added to the $Ni_3Al$ alloys in large quantities since addition of Si beyond a maximum of 3 weight percent will form silicides of nickel and upon oxidation will lead to $SiO_x$. The addition of Mo improves strength at low and high temperatures. Zirconium assists in improving oxide spalling resistance during thermal cycling. Also, Hf can be added to improved high temperature strength.

A preferred $Ni_3Al$ alloy for use as the sleeve 200 and resistive heater 210 is designated IC-50 and is reported to comprise 77.92 at. % Ni, 21.73 at % AI;. 0.34 at % Zr and 0.01 at % B in "Processing of Intermetallic Aluminides", V. Sikka, *Intermetallic Metallurgy and Processing Intermetallic Compounds*, ed. Stoloff et al., Van Nostrand Reinhold, N.Y., 1994, Table 4. Various elements can be added to the aluminide. Possible additions include Nb, Cu, Ta, Zr, Ti, Si, Mo and Ni.

The heater material for heating element 210 can be Haynes® 214 alloy. Haynes® Alloy No. 214 is a nickel-based alloy containing 16.0 percent chromium, 3.0 percent iron 4.5 percent aluminum, traces of yttrium and the remainder (approximately 75 percent) being nickel, commercially available from Haynes International of Kokomo, Ind.). Inconel 702 alloy, NiCrAlY alloy, FeCrAlY, Nichrome® brand alloys (54–80% nickel, 10–20% chromium, 7–27% iron, 0–11% copper, 0–5% manganese, 0.3–4.6% silicon, and sometimes 1% molybdenum, and 0.25% titanium may also be used. Nichrome I is stated to contain, inter alia, 60% nickel, 25% iron, 11% chromium, and 2% manganese; Nichrome II, 75% nickel,; and Nichrome III, a heat-resisting alloy 85% nickel and 15% chromium, as described in commonly assigned U.S. Pat. No. 5,388,594, or materials having similar properties.

More preferably, however, the heating element 210 is made from a heat-resistant alloy that exhibits a combination of high mechanical strength and resistance to surface oxidation, corrosion and degradation at high temperatures. Preferably, the heating element 210 is made from a material that exhibits high strength and surface stability at temperatures up to commonly referred to as super-alloys and are generally based on nickel, iron, or cobalt. For example, alloys of primarily iron or nickel with aluminum and yttrium are suitable. Preferably, the alloy of the heating element 210 includes aluminum to further improve the performance of the heating element, e.g., by providing oxidation resistance.

Preferred materials include iron and nickel aluminides and most preferably the alloys disclosed in commonly assigned, copending U.S. patent applications Ser. No. 08/365,952, filed Dec. 29, 1994, entitled "Aluminum Containing Iron-Base Alloys Useful as Electrical Resistance Heating Elements" and Ser. No. 08/426,006, filed Apr. 20, 1995, entitled "Iron Aluminide Alloys Useful as Electrical Resistance Heating Elements" (Attorney Docket No. PM 1769), which are incorporated by reference in their entireties.

If melting of any alloy is required, preferably an argon gas cover is employed. Electrical leads can be brazed to the resistive heater 210 or sleeve 200 as discussed using a YAG laser or $CO_2$ laser. Brazing can be accomplished with Ag—Cu or Ni—Cu brazing alloys. Brazing is a preferred method over soldering and welding for these purposes since the thickness of resistor is less than 5 mil. (0.005") or 0.125 mm. A flux can be used to wet the surface and clean the oxides. Several such brazing alloys are available from Lucas-Milhaput of Wisconsin and from Indium Corporation of America. Ag—Cu alloys have optimum solidus and liquidus temperatures for laser brazing of a heater without penetrating through the layers since the total thickness of the heater 210 and insulator 310 is 10 to 15 mils.

The present invention provides a multi-layer heater with $Ni_3Al$ as a substrate and as a heater separated by an insulator, zirconia. The concept is generic and can be applied in different thicknesses to various geometries. $Ni_3Al$ readily forms an adherent alumina layer on the surface. This alumina layer will prevent further oxidation and will eliminate spalling of oxides, thereby enhancing cycle life time of the material.

A cylindrical tube of the selected metal having an appropriate length and a wall thickness of approximately 1–10 mils, and preferably 3–5 mils is formed into the desired geometrical shape. In a preferred embodiment; (1) the tube is formed by, e.g., stamping or extrusion; (2) the ceramic and heater layers are deposited; and (3) the heater and electrical leads are bonded. Alternatively, a thin tubing having, e.g., 3 to 5 mil thick walls is provided with an adequate initial diameter.

The tube is cut into desired lengths to subsequently form substrates. Next, conventional swaging techniques are performed to form the desired geometry and size of the substrate and tube(s). Subsequent steps are performed as described to form the sleeves 200. The fabrication of steps defined herein may be performed in any desired order to achieve manufacturing speeds, materials savings, etc.

The heater materials and other metallic components are also chosen based on their oxidation resistance and general lack of reactivities to ensure that they do not oxidize or otherwise react with the cigarette 23 at any temperature likely to be encountered. If desired, the heating element 210 and other metallic components are encapsulated in an inert heat-conducting material such as a suitable ceramic material to further avoid oxidation and reaction.

Alternatively, heating element 210 is arranged in a resistive heating pattern 220 to form a resistance heating circuit powered by an appropriate source of electrical energy. A particularly preferred heating element 210 is shown in FIG. 7 comprising a resistive pattern formed on the outer surface 202 of cylindrical sleeve 200, e.g., a wave pattern having a relatively elongated amplitude in the longitudinal direction of the underlying sleeve 200 as shown. For example, the resistive pattern can comprise tungsten and is applied to sleeve 200, e.g., alumina as discussed, via any conventional technique, e.g. as performed by Ceramx Corporation of Laurens, S.C. The resistive pattern is printed on a plastic tape, transferred to ceramic green tape and then from the tape to the ceramic sleeve via firing.

Any appropriate pattern can be employed to achieve desired operating temperatures as discussed herein. As shown in FIG. 7, the negative and positive terminal ends of the resistive pattern are located near the same end of sleeve 200 for connection with negative and positive pins 104C and 104D.

Alternatively, the resistance pattern, e.g., platinum, is formed in a desired pattern onto the ceramic sleeve 200 as shown in commonly assigned, copending application Ser. No. 08/333,470 filed Nov. 2, 1994, which is hereby incorporated by reference in its entirety. Alternatively, the resistance pattern is formed in a desired pattern onto the ceramic sleeve 200 as shown on a flat substrate in commonly assigned U.S. Pat. No. 5,408,574, issued Apr. 18, 1995, which is a continuation-in-part of commonly assigned U.S.

Pat. No. 5,224,498, issued Jul. 6, 1993, which is a continuation-in-part of commonly assigned U.S. Pat. No. 5,093,894 issued Mar. 3, 1992, which are hereby incorporated by reference in their entireties.

Figures 8A, 8B:
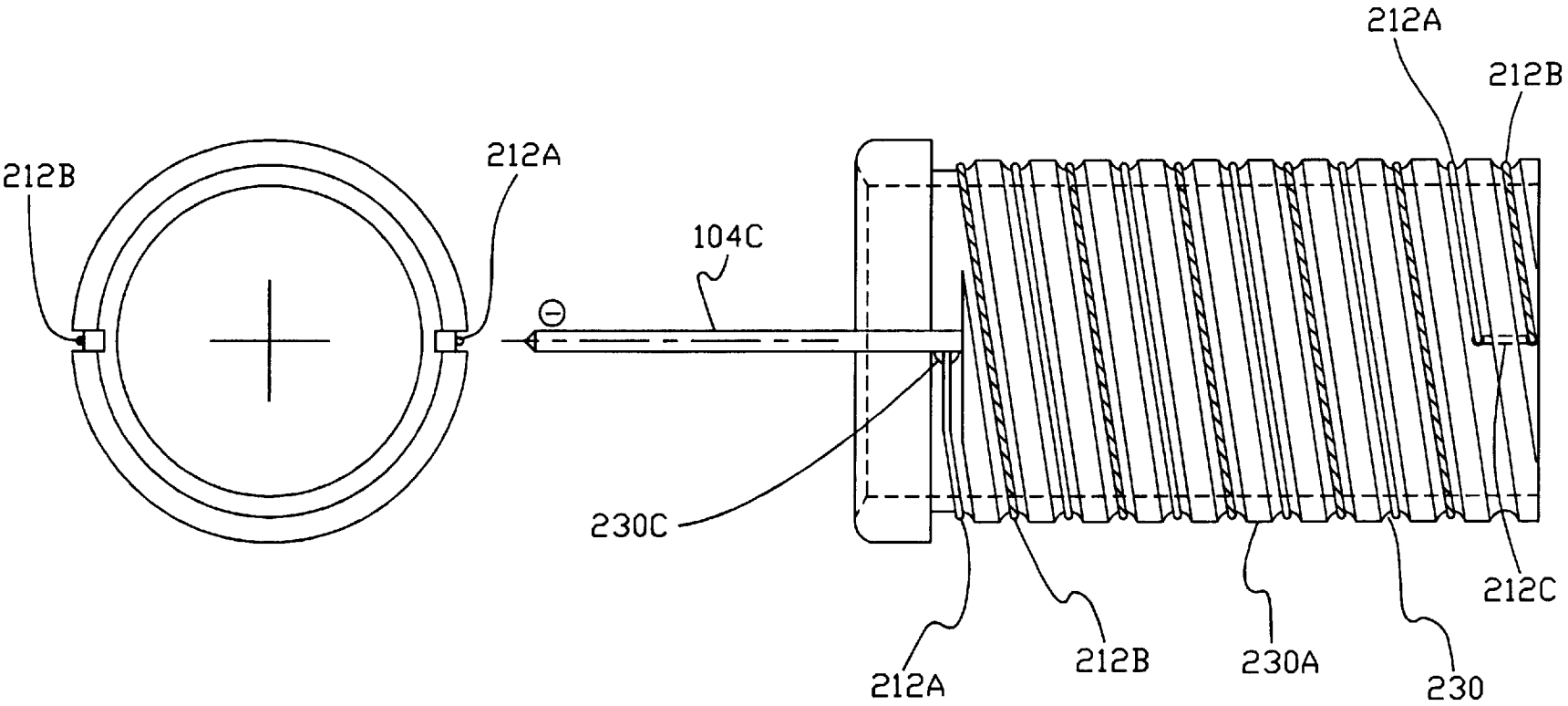
FIG. 8A is a front view of a sleeve and associated heating element having a dual spiral according to the present invention.
FIG. 8B is a side view of the sleeve of FIG. 8A.

As discussed above, when a wire or other continuous resistance pattern is spiralled in groove 203 of sleeve 200, either electrical connections at terminal ends located at opposite sleeve ends or electrical connections as shown in FIG. 6 are necessary. In another preferred embodiment shown in FIGS. 4, 8A and 8B, a continuous wire 212 is cradled in helical groove 203 defined by "hills" of spiral thread 230A shown in FIG. 4. Referring to FIGS. 8A and 8B, continuous wire 212 comprises a first leg 212A and a second leg 212B, the latter of which is striped for clarity of depiction, alternatingly disposed in a respective helical groove 203 of a double-threaded sleeve 200 and separated by such that terminal ends of wire 212 are located at the same end of sleeve 200 for convenient connection to an appropriate power source and control logic.

A connecting segment 212C connects first leg 212A to second leg 212B, specifically by: (1) passing through and into sleeve 200 via a first aperture preferably located at an end, e.g., the distal end, of sleeve 200 opposite pins 104C and 104D, (2) travelling along inner surface 201 for a short interval, and (3) passing through and out of sleeve 200 via a second aperture located in the adjacent spiral turn to the first aperture. By "double-threaded" it is meant that sleeve 200 has two parallel helical grooves. Such a configuration permits electrical connections at terminal ends located at the same sleeve end.

In all of the embodiments, contact areas 230C and 230B permit negative and positive connections to the source of electrical energy. More specifically, a positive connection is made at a first terminal of resistive heating element 210 and a negative connection is made at a second terminal of resistive heating element 210. Preferably, a sleeve negative or common pin 104C and sleeve positive pin 104D are respectively located in base 50, received by additional sockets (not shown) connected ultimately to control circuitry and to the desired sleeve power source, and respectively make the negative connection and positive connection of sleeve heating element 210 to complete the connection to the desired sleeve power source.

Any suitable electrical connection is employed. Preferably, both of the connections of the sleeve heating element 210 with pins 104C and 104D are made at base 50, i.e., the end of fixture 39 opposite the cigarette insertion opening to avoid interference by and with the cigarette. It is noted that the negative, common and positive designations can be alternated in the present invention as depicted with respect to sleeve heating element 210 since only one heater is employed. If desired, multiple heating elements 210 can be employed to heat sleeve 200, and a common can be employed for the multiple heating elements 210.

Figure 16:
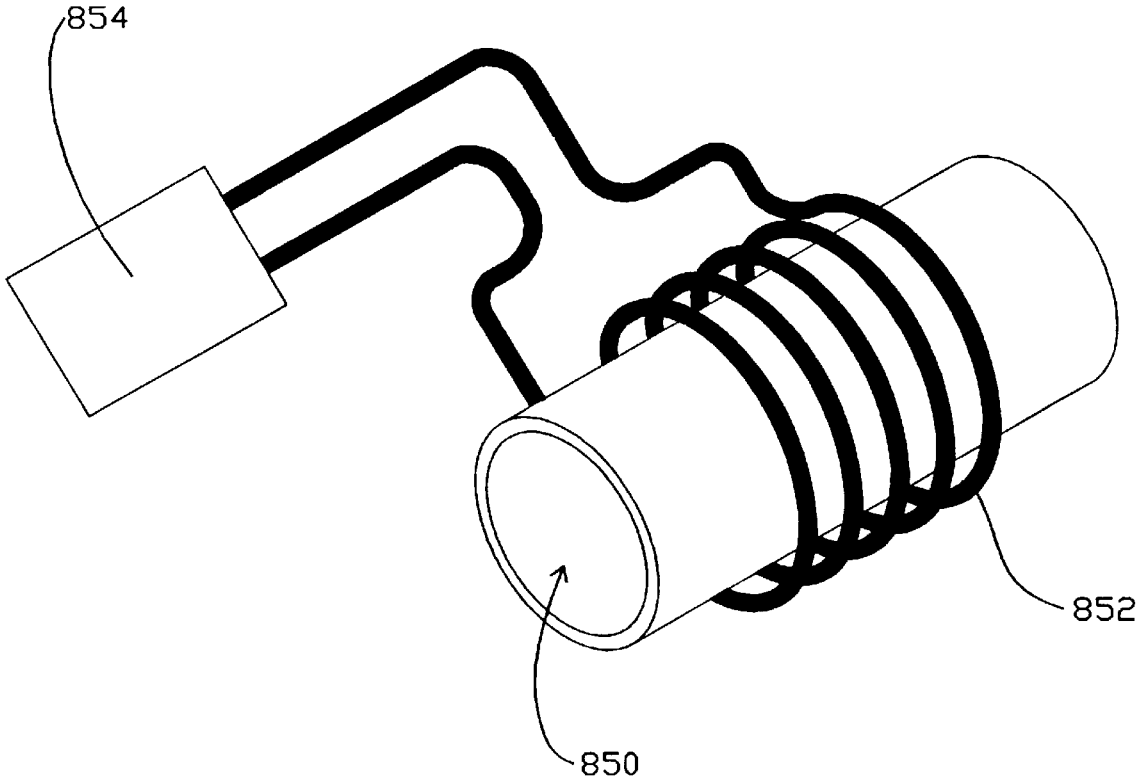
FIG. 16 is a side view of a sleeve and inductive coil for heating the sleeve.

In a different embodiment, the heating of the sleeve may take place by use of an inductive heating apparatus as seen in FIG. 16. Sleeve 850 is formed of an appropriate susceptor material which is capable of sustaining and enduring temperatures high enough to vaporize accumulated deposits by thermal liberation. In the configuration illustrated in FIG. 17, the induction coil 852 is in the lighter housing and is powered by driving circuit 854. The driving circuit should generate a sufficient amount of power (in the vicinity of approximately 10 watts) to sufficiently heat the susceptor tube.

The tube may be made of any suitable susceptor material subject to the requirements of the heater, and the power and frequency requirements chosen accordingly. It has been determined that for, e.g., a stainless steel tube of radius $4.26\times10^{-3}$ m, thickness $7.62\times10^{-5}$ m, length $1.4\times10^{-2}$ m, a frequency of 500 KHz is optimal, with 700 KHz being the maximum useful frequency. A temperature rise of 425° C. from ambient is observed within 5 seconds of the circuit energization.

The number of turns around the tube is variable depending on the power dissipation and size of the tube chosen, but for the exemplary stainless steel tube, 50 turns gives a sufficient magnetic flux density.

The coil may be placed adjacent to the sleeve (placed within the lighter housing), or in a spaced relation to the sleeve (e.g. in the cleaner apparatus housing). In the instance where the inductive coil is placed within the lighter, less power is required, but the coil and associated circuitry is then mounted in the lighter and increases the carry-around weight of the apparatus. In the instance where the inductive coil is place in the cleaner apparatus housing, the power requirement for inductive heating is dramatically increased.

B. The Power Source

The desired sleeve power source can be batteries or other power source 37 of the lighter 25. More preferably, heating element 210 is powered by an external power source such as a recharger unit 500, as described below, which is also suitable for recharging the rechargeable batteries of lighter 25 and connected, e.g., to a conventional wall outlet or other source of AC or DC current capable of providing approximately 25 watts to approximately 50 watts for the cleaning process.

For example, the batteries may require recharging after approximately 160 to 800 heater firings corresponding to approximately 160 to 800 puffs, i.e., equivalent to approximately 20 to 100 cigarettes (assuming 8 firings and puffs per cigarette) or 1 to 5 packs (assuming 20 cigarettes per pack). Conveniently, recharging would take place during an adequately long period of non-use, e.g., at the end of a day or a set number of days, with cleaning preferably occurring at each recharging or at some set multiple thereof. During the use period, condensates accumulate on the inner surface 201 of sleeve 200, the cigarette heating elements 120 and other lighter components with each generated puff.

C. Cleaning Intervals

As the cigarette heating elements 120 are fired to generate a puff, condensates from the previous puff(s) on the cigarette heating elements 120 are usually dissipated by this heating. However, condensates continue to accumulate on the sleeve inner surface 201 and other components.

The need for cleaning and/or recharging can be accomplished by respectively sensing condensate accumulation or some event indicative of accumulation and power capacity. Referring to FIGS. 1, 10 and 11, a counter 55 is provided within lighter 25 to count the desired events which could be used to indicate that cleaning is required, e.g., after a certain number of recharges or every recharge, or after a certain number of cigarettes, puffs or discrete heatings of a cigarette heater, etc. Note that if recharging occurs after a predetermined number of cigarettes, recharge(s), puffs or discrete heatings of a cigarette heater, etc., then counting and storing events for both recharging and cleaning are efficiently combined.

If desired, an icon on display 51 can indicate the need for cleaning in response to a signal from counter 55 upon a predetermined number of event(s) or at some established number of event(s) prior to the predetermined number. In the latter case, the icon is displayed at some determined interval prior to the cleaning trigger event to alert the smoker of the upcoming required cleaning, e.g., so that he or she can initiate the cleaning cycle prior to an intended period of extended use or plan to use another lighter while the current lighter is being cleaned.

Additionally or alternatively, another alert signal can be communicated to the smoker, e.g., any conventional audio signal such as a beep or other generated tone before, with or after the time of the icon display. Further, control logic can "lock out" a smoker if cleaning is not performed, e.g., by the control logic 41 implementing a "stop" mode which prevents firing of the heaters once the counter 55 sends a signal indicative of required cleaning to the control logic 41 of the lighter, e.g., after a predetermined number of smoked cigarettes and/or coincident with required battery recharging. Upon completion of the prescribed cleaning, either lighter control circuitry 41 and/or recharger logic controller 520, depending on the cleaning technique employed, implements a "go" mode to allow use to resume.

All of the foregoing control information is preferably stored in conventional non-volatile memory to permit the cleaning history and associated counting and signalling to be preserved if power source 37 is depleted.

The cleaning cycle is preferably initiated at the determined time by the smoker entering a code and/or activating a push-button, switch, etc. or interfacing the lighter with an external unit such as a recharger unit 500 as described below.

D. The Cleaning Cycle

For example, the lighter 25, with cigarette removed, is inserted or otherwise engaged with a suitable recharger 500 as described below containing a power source and/or connected to a conventional electrical source such as an outlet, whereby electrical power is transmitted from the recharger 500 to the lighter power source 37, e.g., rechargeable batteries, and control signals are transmitted from the recharger to the lighter control circuitry 41. The dedicated sleeve heating element(s) 210 is powered via lighter power source 37, e.g, batteries, or, more preferably, by the recharger 500 at approximately 25–50 watts.

As heating element(s) 210 is resistively heated by the supplied electrical power, the sleeve inner surface 201 is heated, primarily via conduction, an appropriate amount to thermally liberate the condensates thereon. The sleeve 200, and especially the inner surface 201 thereof which accumulates condensates, is heated substantially uniformly to a desired minimum temperature to clean the lighter components effectively, e.g, to preferred operating temperatures of approximately 150° C. to approximately 750° C., e.g., approximately 300° C. to approximately 600° C., e.g., approximately 400° C. to approximately 500° C., e.g., approximately 450° C.

In one embodiment of the cleaning cycle, the desired minimum temperature is reached from room temperature in, e.g., approximately 10 to approximately 90 seconds and held for, e.g., up to approximately 60 seconds. The cleaning cycle is controlled by appropriate logic preferably embodied in either lighter control circuitry 41 and/or control circuitry located in the recharger 500.

In addition, this heating of sleeve 200 transfers heat, primarily via conduction, convection and radiation, to other internal components of the lighter such as air channel sleeve 87 (if employed); passageway 48 (if employed); outer sleeve 84; heater assembly 100 including the heater blades 120; common pin or lead 104A; positive pins or leads 104B; the spacer 49, especially the bottom inner surface 81 of the spacer; base 50; and the passageway 47 in the spacer and the base 50 communicating with the puff sensitive sensor 45 and thereby thermally liberate undesired condensate deposits from these internal components.

Preferably, those component surfaces are heated to approximately 100° C. to approximately 400° C. for, e.g., approximately 10 to 90 seconds.

In all of the embodiments, the heating elements 210 are designed and arranged to heat the sleeve 200, and especially the inner surface 201 thereof, substantially uniformly to a desired minimum temperature to clean the sleeve and lighter components effectively, e.g, to preferred operating temperatures of approximately 150° C. to approximately 750° C., e.g., approximately 300° C. to approximately 600° C., e.g., approximately 400° C. to approximately 500° C. e.g., approximately 450° C. for, e.g., approximately 10 to approximately 120 seconds, or from approximately 30 to approximately 90 seconds, or approximately 20 to approximately 60 seconds.

Certain areas, e.g., portions of sleeve inner surface 201 underlying electrical contact areas 230, could be relatively cooler, e.g., due to heat sink properties of the electrical connecting elements. These cooler regions could be between, e.g., approximately 15° C. to approximately 50° C. cooler than the remainder of the sleeve 200. To ensure that all of sleeve inner surface 201 reach the desired minimum cleaning temperature for thermal liberation, the resistivity of the heating elements 210 and/or the power supplied is selected such that these relatively cooler regions reach the desired minimum cleaning temperature and the other regions are heated to a correspondingly higher, though still suitable, cleaning temperature, e.g., to preferred increased operating temperatures of approximately 15° C. to approximately 50° C. higher than the approximately 150° C. to approximately 750° C. and other ranges in the foregoing examples. It is noted that an alumina or metal sleeve 200 is selected to exhibit substantially uniform thermal conductivity.

Relatively lower temperature volatiles of the condensate are initially vaporized as the water present vaporizes at 100° C. and are released in gas and/or aerosol states. Next, relatively higher temperature condensates undergo revolatilization or pyrolysis and are released. Next, any residual condensates are oxidized. It is believed that one or more of these processes is responsible for the observed cleaning of the sleeve 200 and other condensation surfaces. The thermally liberated condensates are generally referred to as volatiles.

This heating cycle defined by the above temperatures and duration effectively cleans these component surfaces. However, this heat transfer necessitates material specifications in addition to those discussed in, e.g., U.S. Pat. No. 5,388,594 and application Ser. No. 08/380,718, filed Jan. 30, 1995. For example, polymers and other materials should not be employed within thermal proximity of heating element 210 since the temperatures noted above could cause melting or other undesired thermal degradations of these materials.

In an alternative embodiment, the cigarette heaters 120 themselves are used to heat inner surface 201 of sleeve 200 during the cleaning cycle in addition to heating the inserted cigarette 23 during normal smoking, thus obviating the need for a specific dedicated heating element 210 for the condensate sleeve 200, as shown in FIG. 9A. The cleaning cycle is preferably initiated at the determined time by the smoker in response to an indication that cleaning is required.

Cigarette heaters 120 are pulsed, preferably in a rapid sequential pattern, at the determined cleaning time with no cigarette 23 present in the heater assembly 39 to heat sleeve inner surface 201 substantially uniformly to the desired temperature, primarily via radiation and conduction. To attain the desired cleaning temperature range of approximately 150° C. to approximately 750° C., approximately 300° C. to approximately 600° C., e.g., approximately 400° C. to approximately 500° C., for sleeve inner surface 201 for, e.g., approximately 30 to approximately 60 seconds, the individual heater blades 120 are heated to approximately 600° C. to approximately 800° C. and held for approximately 20 to approximately 60 seconds.

If all, e.g., eight, of the cigarette heater blades 120 are continuously supplied with electrical energy for approximately 20 to approximately 60 seconds, the required power would dissipate the capacity of most conventional batteries. Accordingly, energy would be required to be supplied from an external source, e.g., the below discussed recharger unit 500 which in one embodiment is connected to a conventional electrical outlet. In addition, the blades 120 are subjected to sustained heating which could be potentially damaging.

Alternatively, it is desirable to provide the smoker with the option of powering the cleaning cycle with the batteries or other power source 37 of lighter 25 to permit cleaning at various locations without the need to provide a recharger unit and/or to access a conventional electrical outlet. The pulse width modulation discussed below may be applicable to such an application if battery specifications are improved to enable the described heatings of the cleaning process.

E. Pulse Width Modulation To Conserve Battery Power

Figure 10:
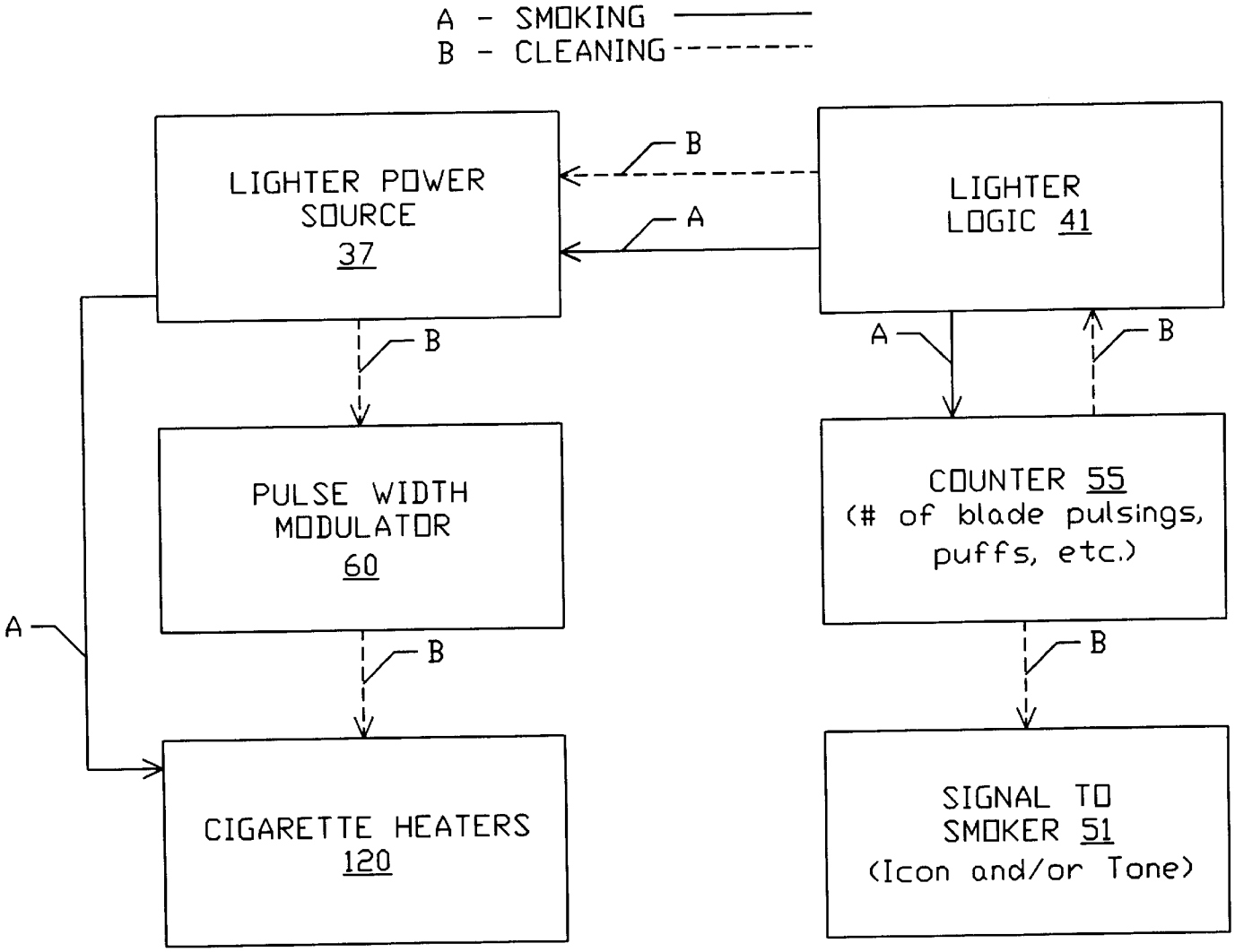
FIG. 10 is a schematic of a cleaning cycle employing a sleeve and cigarette heating elements according to the present invention.
Figure 11:
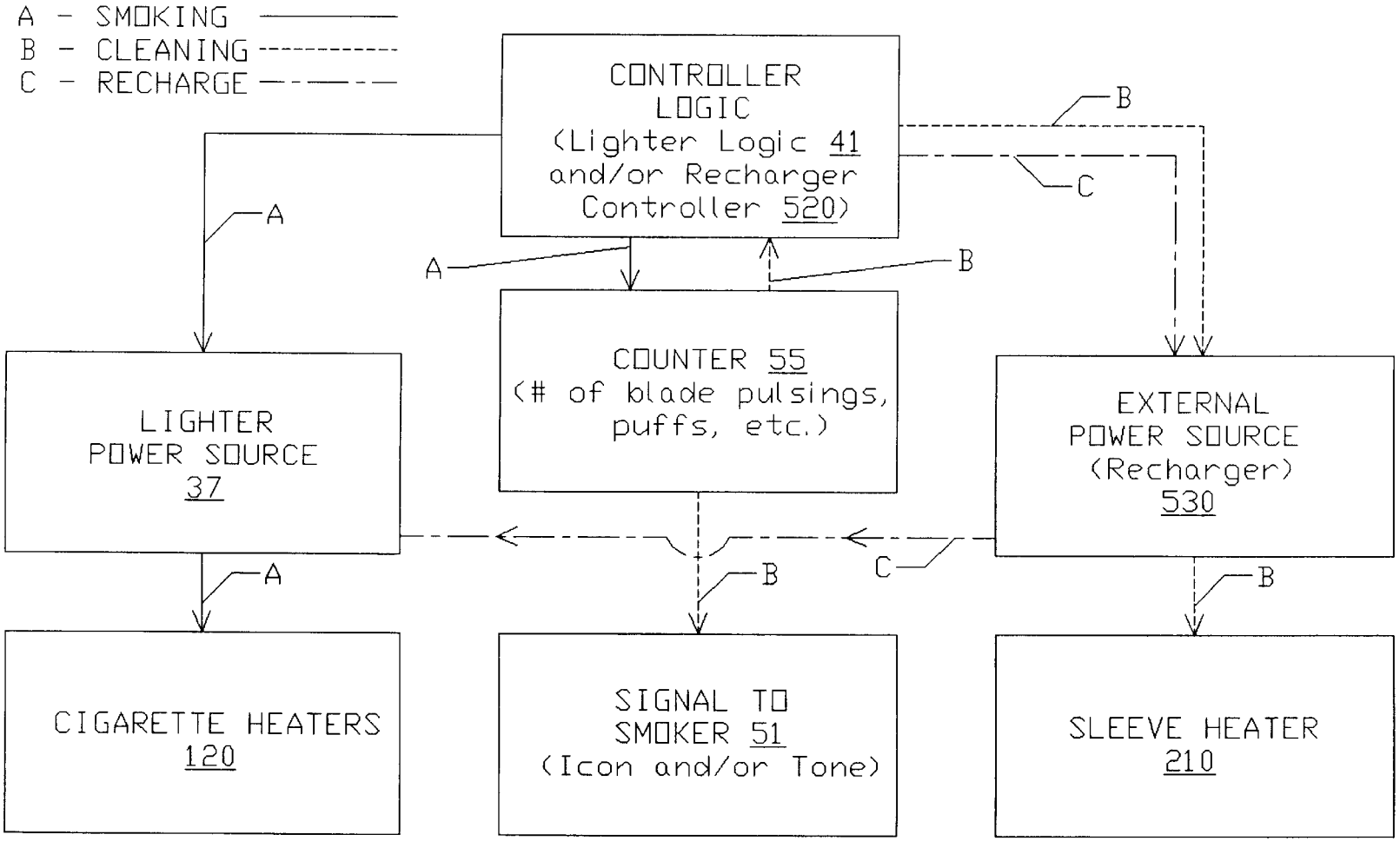
FIG. 11 is a schematic of a cleaning cycle employing a sleeve and dedicated sleeve heating element according to the present invention.

It has been found that modulating the pulse width of each individual cigarette heater blade 120 to fire in rapid succession for relatively brief periods permits substantially uniform heating of sleeve inner surface 201 within energy capacities of available batteries, e.g., by employing a pulse width modulator 60 located in lighter 25 to permit cleaning at desired locations and times, as shown in FIG. 10.

By way of non-limiting example, it could be desired to pulse the energy supplied to the cigarette heaters 120 such that each heater blade 120 is fired approximately 20 to approximately 200 times per second, e.g., approximately 40 to 60 times per second, e.g., approximately 50 or approximately 100 times per second, to achieve the desired sleeve heating.

Preferred pulse widths are determined by considerations including the available power supply, e.g., an external power source; desired ramp-up and hold times for the heating of blades 120 during cleaning; and material properties of blades 120, including the rapid cyclic heatings during cleaning and the operating temperatures during cleaning. If desired, the determined pulse width for each heater could be shortened to prevent excessive heating of the sleeve 200. The heater pulsings of all of the blades 120 can be in any desired order.

Preferably, pulse width modulator 60 is located in the recharger unit 500. Preferably, the power for heating the cigarette blades 120 is supplied by the recharger unit. If desired, the energy supplied to pulse width modulator 60 is appropriately shaped to use energy from both the recharger unit and from the lighter power source 37 to condition the battery.

Employing the cigarette heaters 120 themselves to heat inner surface 201 of sleeve 200 during the cleaning cycle thus effectively cleans inner surface 201. To avoid undesired heat transfer to outer sleeve 84 and/or to the exterior walls of lighter 25, an additional sleeve 215 is provided between outer sleeve 84 and sleeve outer surface 202 and has a heat reflective inner surface 215A surrounding and facing sleeve outer surface 202. Sleeve 215 is preferably separated from sleeve 200 by a gap and is either is contact with or separated from outer sleeve 84.

As cigarette heaters 120 heat sleeve inner surface 201, sleeve outer surface 202 is also heated. Heat radiates from sleeve outer surface 202 and is reflected back toward sleeve outer surface 202 by the heat reflective inner surface 215A of sleeve 215 both to reduce the amount of heat transferred to outer sleeve 84 and/or to the exterior walls of lighter 25 and to increase the heat transfer efficiency to the sleeve outer surface 202 and ultimately to sleeve inner surface 201 to clean inner surface 201.

Sleeve 215 also functions as a heat sink to absorb non-reflected radiative heat to further reduce the amount of heat transferred to outer sleeve 84 and/or to the exterior walls of lighter 25. Additional sleeve 215 having heat reflective inner surface 215A surrounding and facing sleeve outer surface 202 can be provided between outer sleeve 84 and condensate sleeve outer surface 202 in any of the disclosed embodiments of the present invention.

Additionally or alternatively, a cyclic cleaning control scheme for the heater blades is employed wherein the blades are heated for a period, allowed to cool, heated again, cooled again, etc. to further reduce the possibility of overheating heat sensitive components of the lighter 25. For example, the heater blades 120 can be pulsed, preferably pulse width modulated as discussed, for, e.g., a period of approximately 10 to approximately 30 seconds in an "on" mode allowed to cool for, e.g., a period of approximately 200 to approximately 300 seconds in an "off" mode. This procedure is cycled for an adequate time to clean the components, e.g., for 1 to 20 of these "on-off" cycles.

In all of the above embodiments, the control logic for controlling the pulsings of the cigarette heaters 120 via the appropriate power source is contained either in the control circuitry 41 of lighter 25 or in control circuitry of an external component, e.g., the recharger unit.

F. Cleaning Lock-Out

In all of the embodiments, the tobacco containing cigarette 23 is preferably removed from the lighter by the smoker prior to initiating the cleaning cycle, and thus the heating element(s) employed in cleaning does not heat the tobacco to evolve flavors during the cleaning cycle. In a preferred embodiment, the control circuitry 41 of lighter 25 and/or recharger logic controller 520 will "lock out" or prevent a cleaning cycle by implementing a "stop" mode which prevents firing of the heating element 210 if the light sensor 53 indicates that a cigarette 23 is present in the lighter 25.

Similarly, the control circuitry 41 of lighter 25 and/or recharger logic controller 520 will "lock out" or prevent a cleaning cycle by implementing a "stop" mode which prevents firing of the cigarette heating elements 120 if the light sensor 53 sends a signal indicating that a cigarette 23 is present in the lighter and if, as discussed above, the counter 55 has sent a signal indicating that cleaning as required. Either lighter control circuitry 41 and/or recharger logic controller 520 implements a "go" mode to allow cleaning, including actuation of heating element 210 or the heater blades 120, if the light sensor 53 indicates that a cigarette is not present.

G. Air Flow Management and Maintenance

Two, preferably distinct, air flow paths from the outside air, into the lighter 25 and toward the inserted cigarette 23 are respectively shown via an arrow ended line in FIG. 3 and in FIG. 9A. Referring first to FIG. 3, when the smoker draws on the inserted cigarette 23, outside air enters the interior of lighter 25 via air channel sleeve 87 located through end cap 83, is directed along gap 208 by the sleeve inner surface 201 of the sleeve 200, and flows towards the inserted cigarette 23 as further described in U.S. Pat. No. 5,060,671 and U.S. patent application Ser. Nos. 07/943,504 and 08/380,718, which are incorporated by reference in their entireties.

As noted above with respect to FIG. 4, a defined inner spiral groove on sleeve inner surface 201 serves to further direct or channel air drawn by a smoker into the lighter housing around the inserted cigarette 23 in a spiral course, thereby advantageously supplying drawn air to various circumferential locations of the cigarette to result in a more uniform distribution of air and a more thorough mixing in the lighter housing. A smooth cylindrical surface surrounding the inserted cigarette 23 results in air, drawn by a smoker into the lighter housing, being directed in a more streamlined manner and a less thorough mixing in the lighter housing.

Referring now to FIGS. 9A–9E, when the smoker draws on the inserted cigarette 23, outside air enters the lighter 25 via passageway 48 located through one lighter side wall and outer sleeve 84. This drawn air is initially directed along the shown path toward the distal end of the lighter 25 relative to opening 27 by either the outer surface 202 of the sleeve 200 or, if employed, along the outer surface of sleeve 215 opposite reflective inner surface 215A.

This sleeve outer surface 202 or, if employed, the outer surface of sleeve 215, thus functions to prevent a portion of drawn outside air from impinging directly on the heater blade 120 underlying the passageway 48 with every puff, thereby preventing undesirable alterations to the above described desired path and possibly to subjective qualities of the smoked cigarette. The air is then directed around a distal end of sleeve 200, along gap 208 by the sleeve inner surface 201 and towards the inserted cigarette 23.

Unimpeded flow from the sleeve outer surface 202 or, if employed, the outer surface of sleeve 215 will tend to concentrate the pressure drop at a portion of gap 208 underlying passageway 48 with every puff, thereby causing potentially inconsistent subjective attributes for each puff generated by a respective circumferentially arranged heater blade 120. Accordingly, it may be desirable to establish a more uniform flow within gap 208 about cigarette 23 to provide relatively consistent subjective attributes for each puff generated by a respective one of the circumferentially arranged heater blades 120.

To establish a substantially uniform pressure drop at all locations at a distal end of gap 208, an annular portion or shoulder 209 is located on or near a distal end of sleeve outer surface 202 between sleeve 200 and outer sleeve 84. Annular shoulder 209 is configured to redistribute the air flow to establish a substantially uniform pressure drop. For example, annular shoulder 209 can comprise a porous plug of an appropriate material having the requisite porosity distribution to establish a uniform pressure drop, e.g., a distribution of drawn air.

Figure 9B:
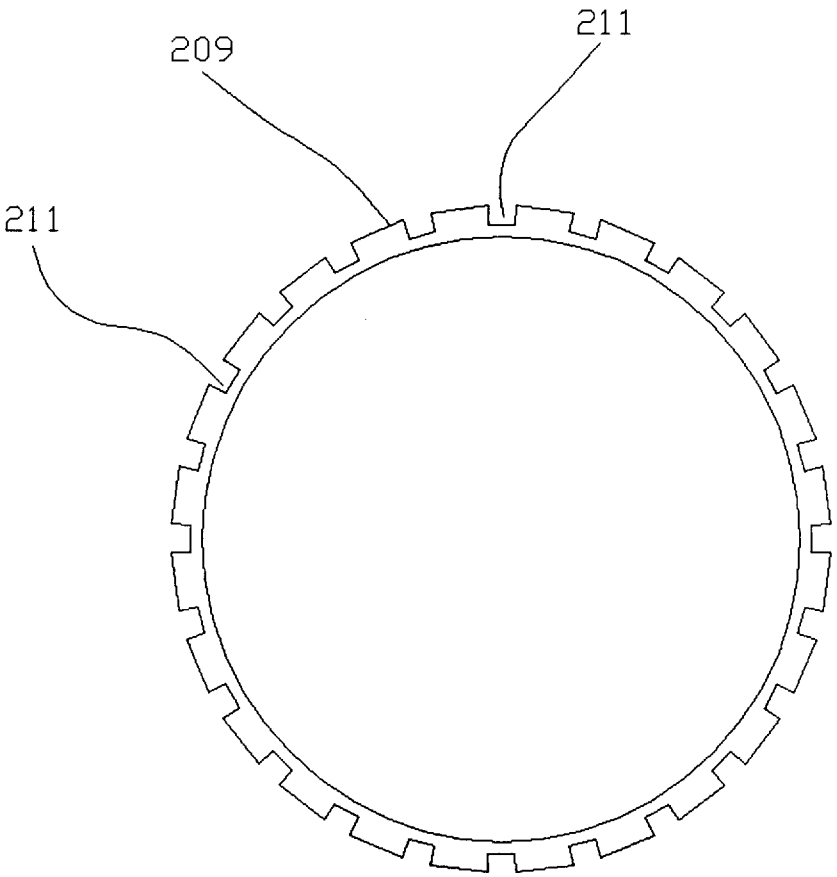
FIG. 9B is an end view of a sleeve shoulder having air slots arranged according to a first embodiment of the present invention.
Figure 9C:
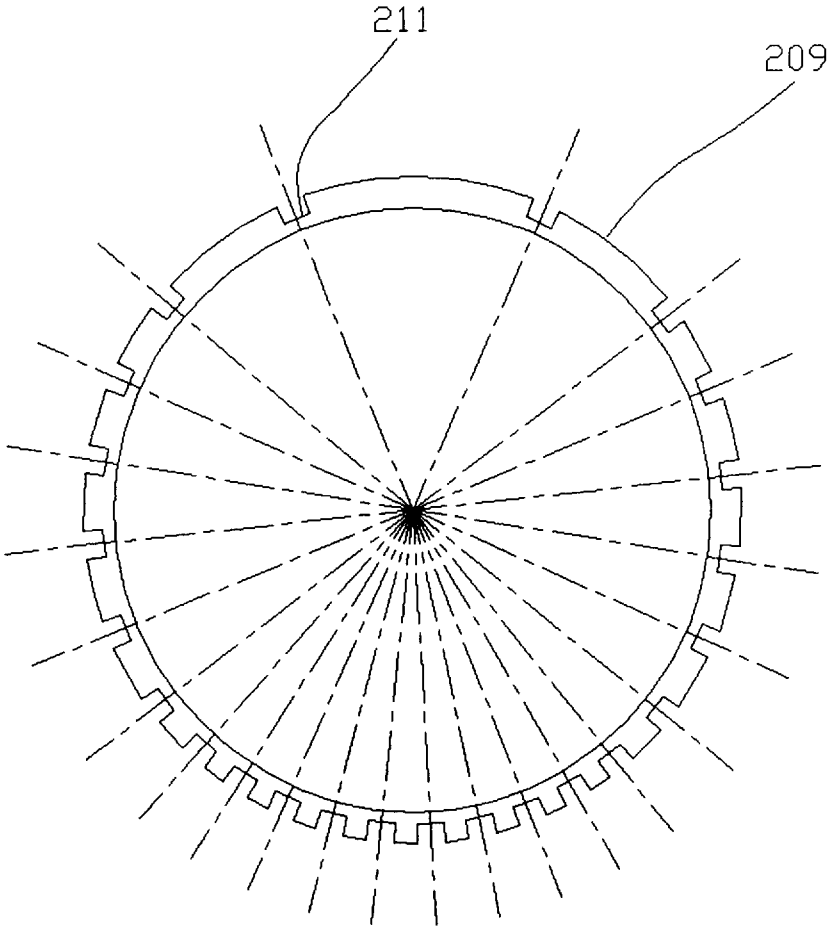
FIG. 9C is an end view of a sleeve shoulder having air slots arranged according to a second embodiment of the present invention.

In other embodiments shown in FIGS. 9B–9E, annular shoulder 209 defines a substantially airtight seal between sleeve 200 and outer sleeve 84 except for a plurality of circumferential grooves or slots 211 therethrough to redistribute the air flow and establish a substantially uniform pressure drop. For example, as shown in FIG. 9B, grooves 211 are uniformly sized, e.g., approximately 0.015 in. wide, and uniformly distributed at, e.g., twenty four intervals. As shown in FIG. 9C, grooves 211 are uniformly sized, e.g., approximately 0.015 in. wide, and nonuniformly distributed such that grooves 211 are more spread apart overlying the portion of gap 208 underlying passageway 48 where the pressure drop tends to concentrate, i.e., more uniformly sized grooves 211 are present at other portions of the gap to provide more air thereto to equalize airflow to gap 208.

Figure 9D:
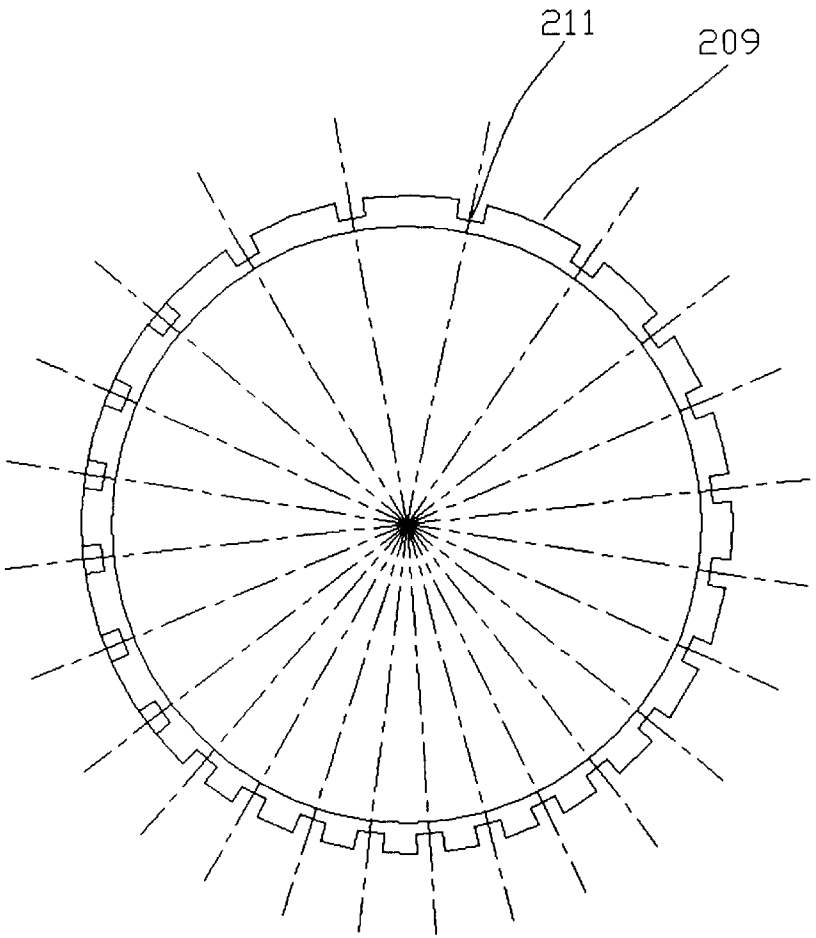
FIG. 9D is an end view of a sleeve shoulder having air slots arranged according to a third embodiment of the present invention.
Figure 9E:
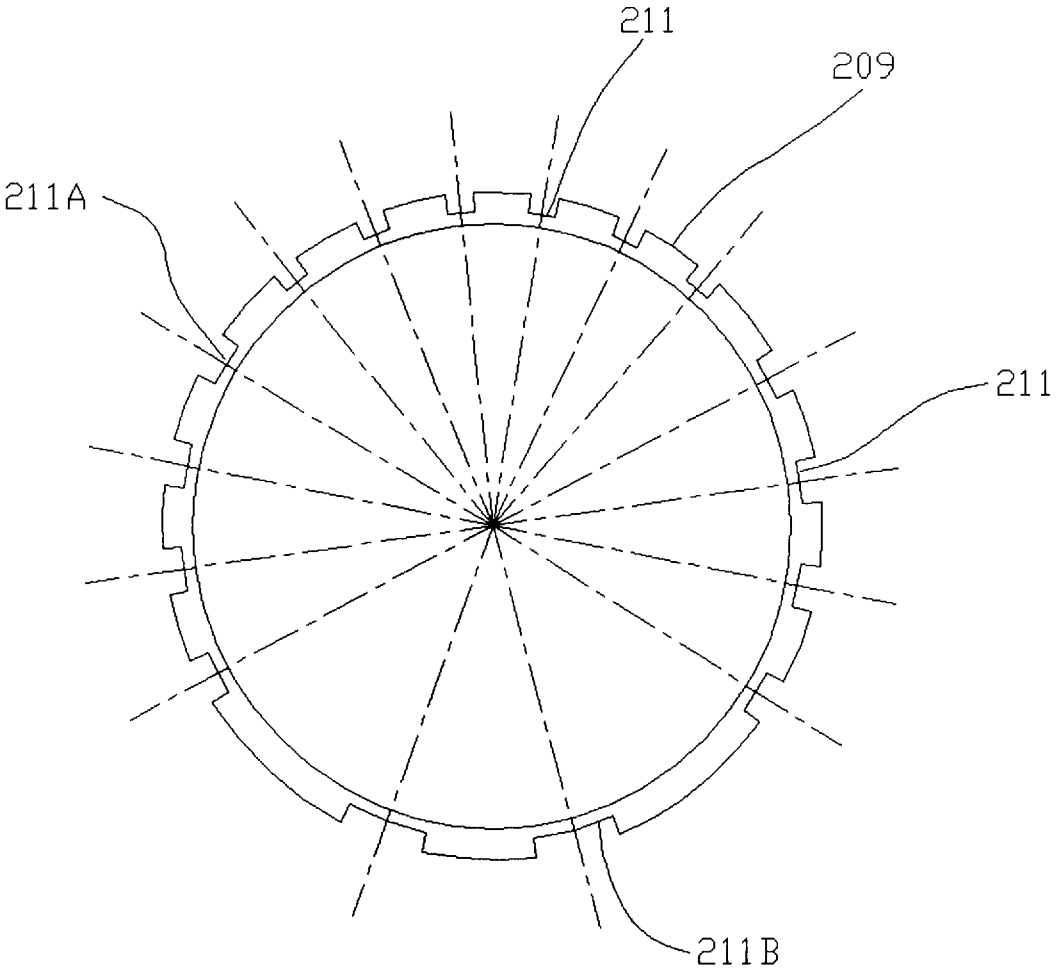
FIG. 9E is an end view of a sleeve shoulder having air slots arranged according to a fourth embodiment of the present invention.

As shown in FIG. 9D, grooves 211 are uniformly sized, e.g., approximately 0.015 in. wide, and nonuniformly distributed, although the distribution shown in FIG. 9D is more uniform than the distribution shown in FIG. 9C. As shown in FIG. 9E, the defined grooves are nonuniformly sized and nonuniformly distributed. More specifically, in FIG. 9E the grooves 211 are, e.g., approximately 0.015 in. wide and are located at the portion of gap 208 underlying passageway 48 where the pressure drop tends to concentrate.

A number of adjacent larger, e.g., approximately 0.025 in. wide, grooves or slots 211A are located circumferentially adjacent to grooves 211, and still larger, e.g., approximately 0.045 in. wide, grooves or slots 211B are located circumferentially adjacent to grooves 211A.

The depicted and described embodiments, shown by way of non-limiting examples, are intended to redistribute the air flow initially directed via passageway 48 to the upper portions of annular shoulder 209 in FIGS. 9B–9E and thereby establish a substantially uniform pressure drop and air flow within gap 208 about cigarette 23.

As noted above with respect to FIG. 4, a defined inner spiral groove on sleeve inner surface 201 serves to further direct or channel air drawn by a smoker into the lighter housing around the inserted cigarette 23 in a spiral course, thereby advantageously supplying drawn air to various circumferential locations of the cigarette to result in a more uniform distribution of air and a more thorough mixing in the lighter housing.

A smooth cylindrical surface surrounding the inserted cigarette 23 results in air drawn by a smoker into the lighter housing being directed in a more streamlined manner and a less thorough mixing in the lighter housing. If desired, the puff sensitive sensor 45 is located within passageway 48.

H. The External Maintenance Unit

Referring to FIGS. 11 and 12A–12D, preferred embodiments of a recharger unit 500 are shown comprising a battery recharger power supply 510 connectable to an external power source such as a wall outlet; a recharger logic controller 520 schematically shown in FIGS. 11; and a sleeve heater power supply 530. Battery pack 37*a*, 37*b* containing rechargeable batteries 37 is detachable from the housing of lighter 25 in a conventional manner, e.g., via known male and female socket type electrical and mechanical contacts.

Figure 12C:
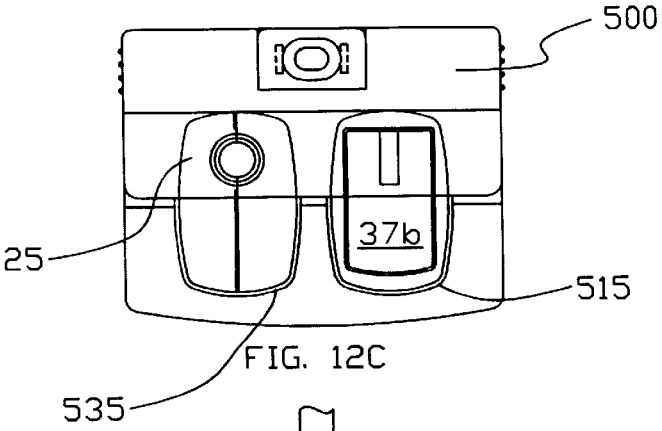
FIG. 12C is a front view of a recharger according to the present invention.
Figure 12A:
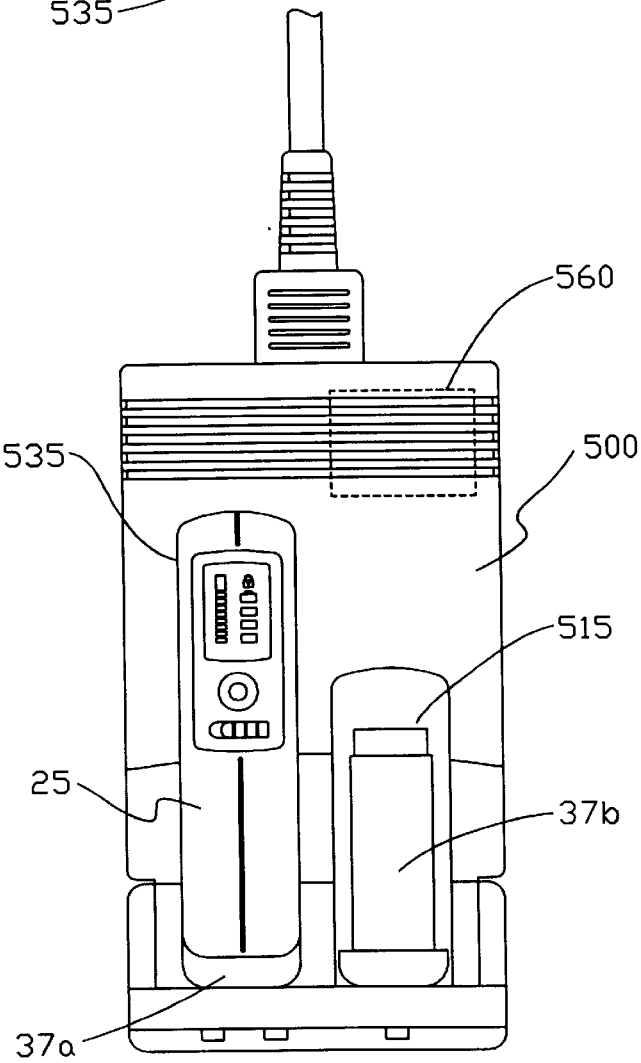
FIG. 12A is a top view of a recharger according to the present invention.
Figure 12B:
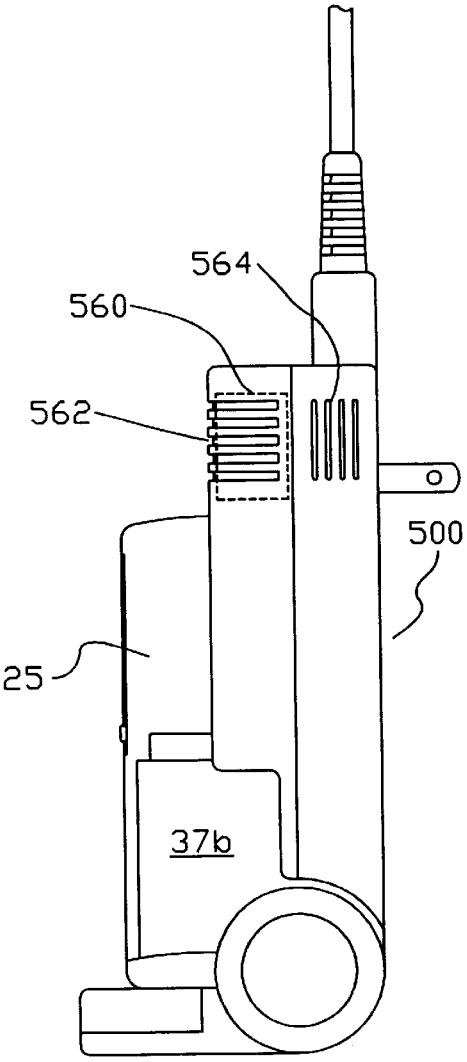
FIG. 12B is a side view of a recharger of FIG. 12A according to the present invention.

In a first embodiment shown in FIGS. 12A–12C, one depleted battery pack 37*b* is situated in battery pack receptacle 515 to interface with any appropriate battery recharger power supply 510. Another charged battery pack 37*a* is connected to lighter 25 to provide a portable power supply when the lighter is not interfacing with recharger unit 500. As described more fully below, the two battery packs 37*a*, 37*b* are then conveniently switched upon depletion of one battery pack to provide a charged battery pack for the lighter and to begin recharging of the depleted battery pack.

Either before or, preferably, after this switch, cleaning of the lighter 25 is performed. In one embodiment, the lighter 25 is situated in heater power supply receptacle 535 to interface with recharger power supply 530. This electrical energy supply is controlled by control circuitry 41 of lighter 25 and/or recharger logic controller 520 of recharger unit 500. The cleaning cycle is initiated upon positioning lighter 25 within receptacle 535 and is conducted as described. See the schematic of FIG. 11.

Figure 12D:
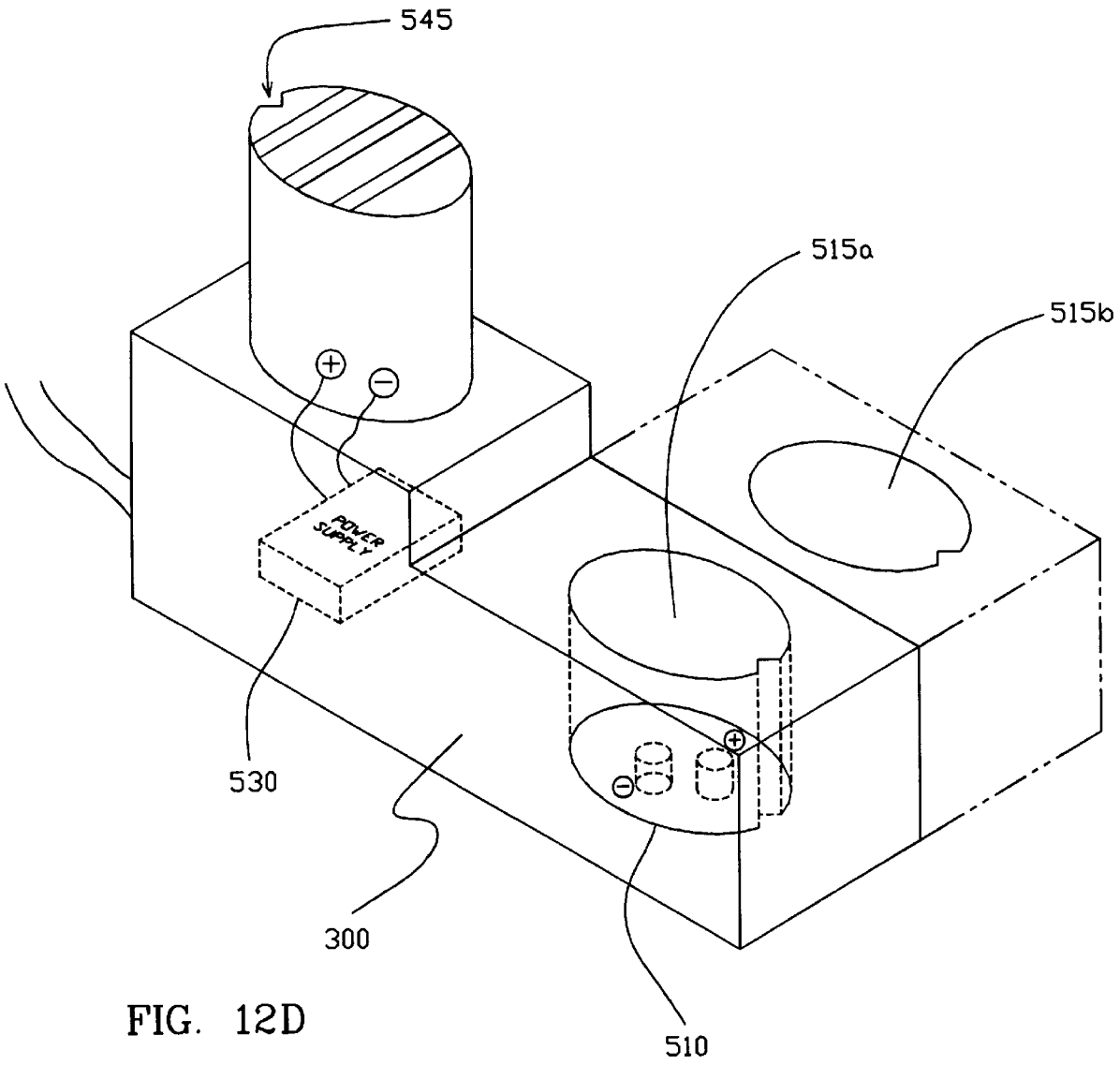
FIG. 12D is a perspective view of a recharger/base unit according to the present invention.

Various alternate embodiments are optionally employed. For example, as shown in FIG. 12D, two battery pack receptacles 515*a* and 515*b* are employed with employed with a single recharger unit 500. Recharger 510 is preferably connected to one battery pack receptacle 515*a*, and the other battery pack receptacle 515*b* functions as a storage port. This battery pack receptacle 515*b* functioning as a storage port does not require electrical connections to also function as a recharging port, but can optionally have such connections to permit recharging of a second battery pack 37*b*.

A cleaning pedestal 540 extends from an upper surface of recharger unit 500 and is sized such that, upon proper positioning, pedestal 540 rests within lighter 25 in lieu of the recently removed, depleted battery pack. Pedestal 540 is connected to recharger power supply 530 and is provided with an orientation slot 545 to couple with a corresponding surface (not shown) of lighter 25 to ensure appropriate orientation for electrical connections.

Figure 17:
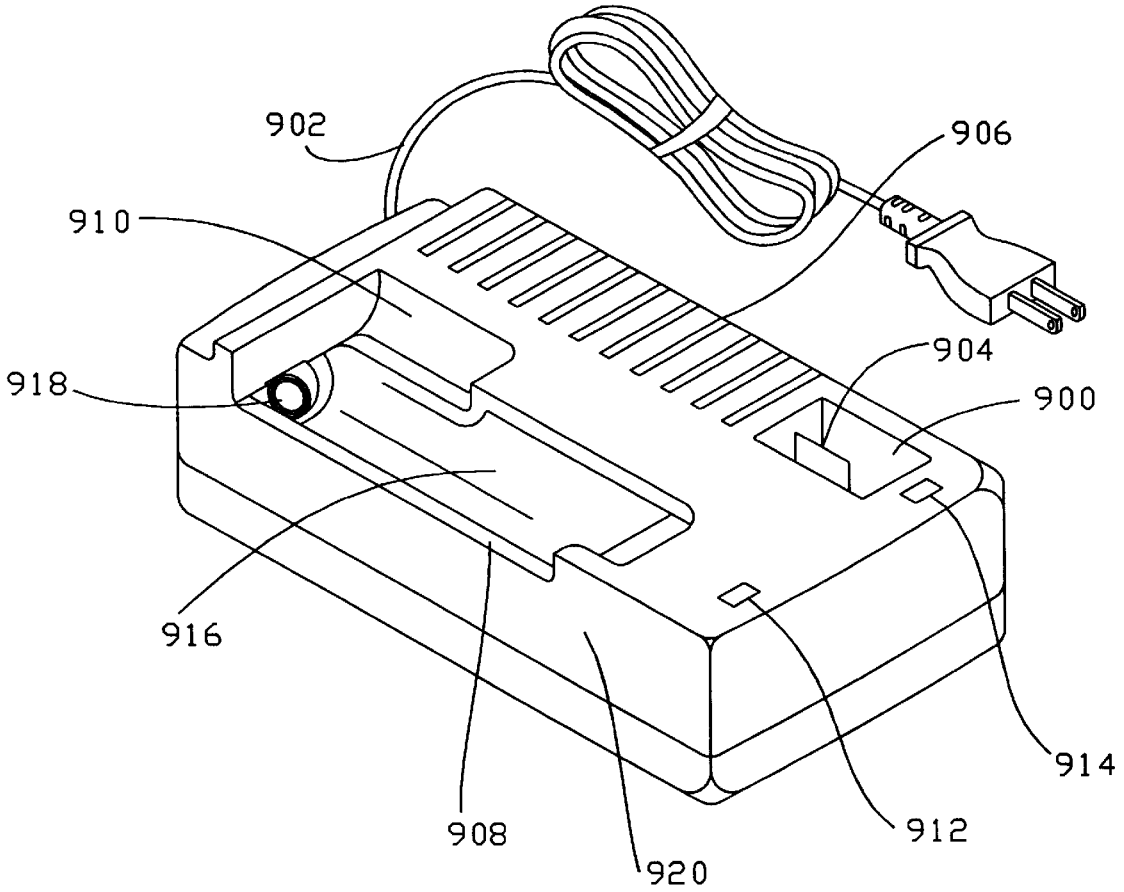
FIG. 17 is a perspective view of a preferred base unit for the present invention.

A presently preferred embodiment is illustrated in FIG. 17. Base unit 920 is formed with spare charging port 900 which has flute 904 for ensuring correct battery orientation. Power cord 902 supplies AC power to the system and a transformer (not shown) converts it to DC power of appropriate voltage and amperage. Indicator 914 shows the charging mode of charging port 900 (i.e. its operational status—charging, charged, standby). Charging is controlled by power management circuitry.

Lighter port 916 receives the hand held lighter. Cavity 910 allows for easy grasping of the inserted lighter for ease of removal. Indicator 912 indicates the status of the lighter, e.g. charging, cleaning, cleaned, and charged. Aperture 918 is fluidly connected with a fan (not shown) which exhausts the volatilized substances from the lighter and exhausts them through vents 906.

Optionally, the volatilized condensates may be broken down by catalytic degradation. Downstream from the aperture and before the exhaust vents a supported platinum catalyst may be mounted in the charging/cleaning unit. Electromagnetic induction or resistive heating is used to heat a support material coated with platinum. If the heater is inductive, an appropriate inductor (e.g. stainless steel) is used. The heater is heated to a temperature of from 200°–800° C., most preferably about 300° C. to degrade the liberated condensates.

The fan intakes sufficient oxygen to decompose the condensate without a significant visible or odorifous product. If desired, a heat exchanger may be utilized to cool the exhaust gases.

To initiate the maintenance procedure, a charged battery pack is moved from the battery charger receptacle 515*a* to the storage port 515*b*. The depleted battery pack is then removed from lighter 25 and placed in the recently vacated battery charger receptacle 515*a* for charging.

For example, a depleted battery pack is removed from lighter 25 by unlocking an appropriate coupler via switch 640. Lighter 25 is coupled to pedestal 540 and thus to power supply 530 via appropriate electrical contacts, e.g., via known male and female socket type electrical and mechanical contacts, to accomplish cleaning as described. Upon completion of cleaning in approximately ten minutes as described, the lighter 25 is removed from pedestal 540, the charged battery pack is removed from the storage port 515*b* and coupled to the lighter 25.

Upon timely conclusion of cleaning, e.g., a few minutes, the lighter 25 is decoupled from recharger unit 500 by the smoker and is immediately ready to be smoked with the charged battery pack, while the relatively longer recharge cycle, e.g, several hours or overnight, is performed for the other depleted battery pack remaining in recharge port 515*a*. Such a contemporaneous full cleaning cycle and initiation of a recharge cycle simplifies use of the lighter 25 and establishes a routine, e.g., a daily routine, for the smoker to ensure proper maintenance for the lighter.

In addition, a single counting of cigarette heater firings, cigarettes smoked, etc., is performed both for recharging and cleaning, thereby simplifying lighter logic. Further, a single icon and/or tone as discussed below can be employed to alert the smoker that recharging and cleaning are required.

This contemporaneous full cleaning cycle and initiation of a recharge cycle also increases the effectiveness of the cleaning since condensate accumulation is reduced by the routine, e.g., daily, cleaning. The cleaning is preferably initiated during, immediately prior to, or after the initiation of the recharging and is preferably completed after a few minutes. Upon heating, these released condensate or volatiles will then exit the lighter 25 via orifice 27.

An ejection and protective plunger system as described in commonly assigned copending patent application Ser. No. 08/483,363, filed Jun. 7, 1995, which is incorporated by reference in its entirety, can be employed with lighter 25. If so, the plunger is positioned in its retracted or operational position at the distal end relative to orifice 27 of the cigarette receptacle defined by blades 120 rather than in an alternative position at the proximal end of the cigarette receptacle, thereby permitting exit of the thermally liberated condensates. Also, pedestal 540 is configured to accommodate any employed plunger system.

I. Containment of Liberated Condensates

It may be desired to minimize the escape of these released condensates via orifice 27, e.g., since the odor or appearance of these released condensates may be objectionable to some smokers or others. Accordingly, a filter or any other conventional vapor, gas, aerosol, smoke etc. containment mechanism can be employed to trap the thermally liberated condensates upon exit from the lighter.

For example, commercially available, so-called smokeless ashtray technology employing fans or other devices to direct the thermally liberated condensates to a filter, electrostatic precipitators, catalysts or other conventional containment mechanism could be adapted to trap the thermally liberated condensates and, if desired, could be combined with the recharger unit.

For example, as shown in FIGS. 12A–12C, a filter/fan mechanism 560 is provided. As released condensates exit lighter 25 via orifice 27 in response to the described heating cycle, they are drawn, e.g., by an appropriate fan, through entry port 562 located on a surface of recharger unit 500 adjacent the lighter 25 resting in receptacle 535 or supported on pedestal 540.

The released condensates are then filtered and/or decomposed and/or treated in any conventional manner within the recharger unit 500, and then the resulting stream exits recharger unit 500 via exit port 564. Also, additional air can be added to dilute this stream to reduce the density and visibility of the exit product.

Alternatively, an insert having the approximate dimensions of cigarette 23 is insertable into receptacle CR to prevent potentially objectionable released condensates or volatiles from exiting the lighter, e.g., to function as a trap or a filter. This insert actively or passively adsorbs, attracts and/or catalyzes a breakdown of the condensates released by the heating of sleeve 200. Examples of insert approaches include a high surface area solid or liquid; solid polymeric or non-polymeric adsorbents, thermally or non thermally activated, including positively or negatively charged or neutral media or combinations of same; conventional cigarette filters; and statically charged media. The supported platinum catalyst as discussed relative to FIG. 17 above is one such example.

As described above, low temperature cycling of approximately 200°–300° C. of the insert by the heated sleeve 200 or the cigarette heaters 120 constitutes the mechanism for condensate volatilization and transfer to the adsorbent. The heated condensates will tend toward the relatively cooler surfaces of the insert and will tend to be adsorbed thereby. For example, various forms of carbon, e.g., charcoal, are carried on a suitable substrate such as paper and/or cellulose acetate. For example, a cigarette-sized insert is employed having a catalytically active surface, either thermally or non thermally activated, which operates in conjunction with low temperature cycling (200°–300° C.) to convert evolved condensate species to low molecular weight, vapor and gas phase products which will readily be purged from the heater cavity.

Figure 13:
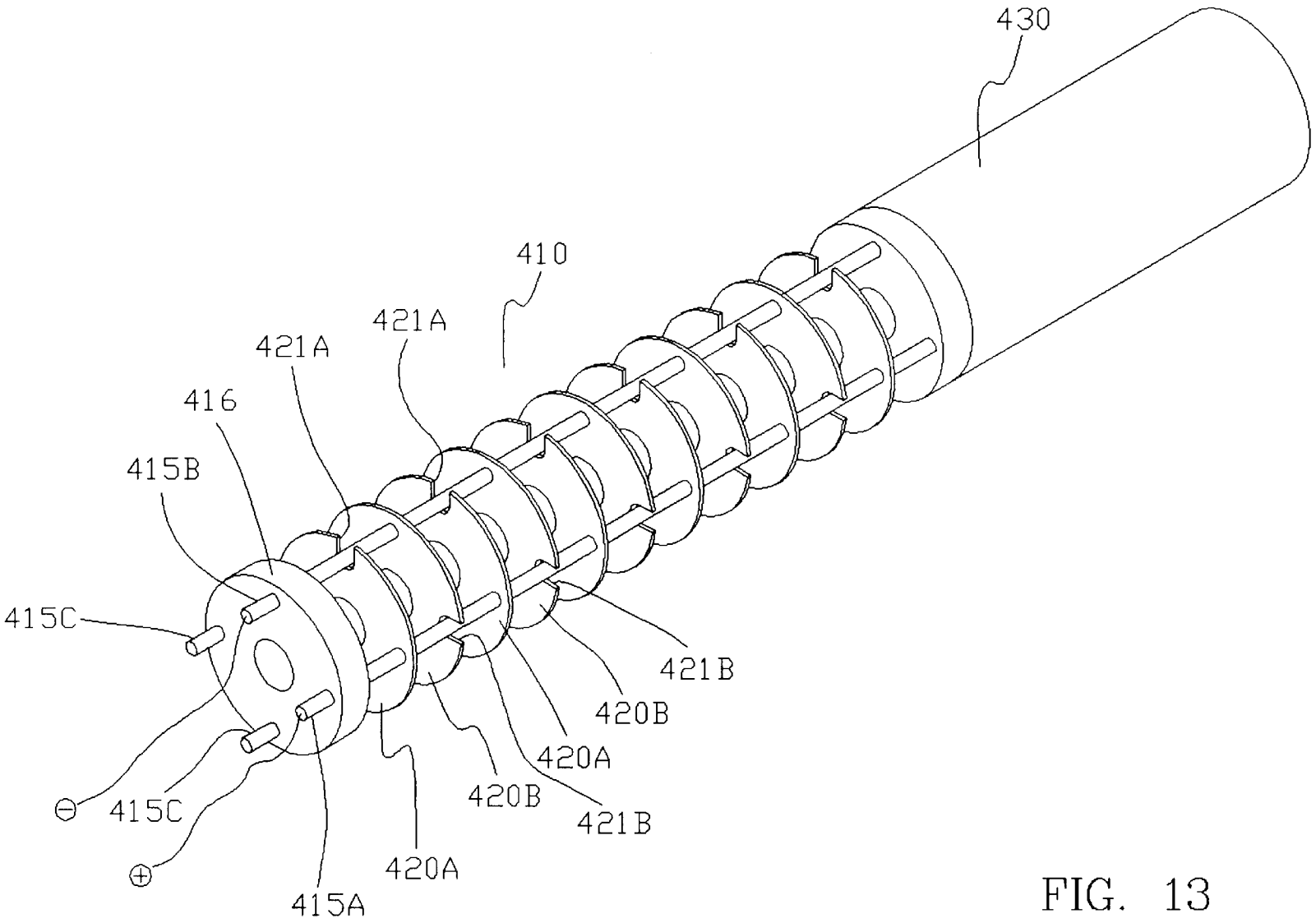
FIG. 13 is an isometric view of an electrostatic precipitator according to the present invention which is insertable into an electrical lighter.

Another example of an active insert is shown in FIG. 13. An electrostatic precipitator 410 is coupled through contacts in the base 50 with a high voltage, low current circuit in the recharger unit 500 controlled either by the lighter logic or, preferably, the recharger logic with power applied either from the batteries 37 or, preferably, from line voltage as modified by the recharger unit 500. Electrostatic precipitator 410 attracts and binds the thermally liberated condensate particulates.

More specifically, precipitator 410 comprises a plurality of positively charged discs 420A and a plurality of negatively charged discs 420B that are arranged in an alternating cylindrical arrangement with a capacitance gap between adjacent, oppositely charged discs. Each positively charged disc 420A has a central circular aperture and a respective peripheral notched area 421A, and each negatively charged disc 420B has a central circular aperture and a respective peripheral notched area 421B. The central circular apertures of these discs provide a continuous air flow path through the electrostatic precipitator 410.

A plurality of, e.g., four, support rods extend from an electrically non-conducting end disc 416 to an oppositely located, electrically non-conducting end piece 430, which is preferably a porous sintered ceramic. One of the support rods functions as a positive connection rod 415A which electrically contacts each disc 420A, preferably via spot welding, and is connectable to an appropriate positive contact.

Positive connection rod 415A passes through the notches of negatively charged discs 415A and is accordingly electrically isolated from notched areas 421B of the oppositely charged discs 420B.

A second support rod functions as a negative connection rod 415B which electrically contacts each disc 420B, preferably via spot welding, and is connectable to an appropriate positive contact. Negative connection rod 415B passes through the notches of positively charged discs 415A and is accordingly electrically isolated from notched areas 421A of the oppositely charged discs 420A. The remaining two rods 415C function as mechanical supports and are preferably spot welded to all of the discs 420A and 420B.

The remaining two rods 415C are nonconducting or the discs are alternately notched as described above to prevent electrical short circuits. All of the components of the electrostatic precipitator 410 should be capable of accomplishing numerous cleaning operations if desired. Preferably, the discs are enclosed by an electrically nonconducting cylindrical sleeve which is perforated or highly porous and preferably is a ceramic.

The electrostatic precipitator 410 is inserted, preferably end piece 430 first, into the cigarette receptacle of the lighter 25. The lighter is then inserted into receptacle 535 of recharger unit 500 such that respective positive and negative connections are made with positive rod 420A and negative rod 420B of the electrostatic precipitator 410 to supply a current thereto, e.g, approximately 50 to approximately 70 microamps at approximately 1 to approximately 2 KV, wherein a potential difference is established between adjacent positively charged discs 420A and negatively charged discs 420B to attract condensate particles thermally liberated from lighter inner surfaces.

Recharger 500 is preferably connected to a 110 V AC current or other household current and has appropriate circuitry to establish this potential. After an appropriate time, e.g., approximately 10 to approximately 30 minutes, the lighter 25 is removed from the receptacle 535 of the recharger unit 500, and the insert is removed from the lighter for disposal and replacement. If sufficient power is provided by lighter power source 37, e.g., during recharging or cleaning accomplished with the cigarette heater blades 120, the insert is inserted end disc 416 first into lighter 25 and positive and negative rods 415A and 415B connect to appropriate electrical connections (not shown) within the lighter to develop the potential as described.

Each of the above approaches is configured into an insert having similar geometric dimensions to cigarette 23 and which is interfaced with the lighter during the recharge cycle in the same manner as the cigarette 23. The smoker conveniently inserts and removes the cleaning insert in the same manner as his/her cigarette. Use of this insert will be unobtrusive to the smoker since it is only used during the recharge cycle. The insert, after removal from the lighter following the recharge or cleaning cycle, may be disposable or reusable depending on the insert approach(es) used.

A reusable insert in particular may be more easily incorporated into conventional packages (e.g. cartons) with the cigarettes themselves. In addition to the trapping properties of such an insert, there are additional cleaning benefits associated with the physical contact between the insert and the cigarette heaters 120 and collar during insertion and retraction.

I. Iconic Displays

Any of the icons and associated logic employed in copending, commonly assigned patent application Ser. No. 08/483,363, filed Jun. 7, 1995, which is hereby incorporated by reference in its entirety, can be employed in the present invention. For example, referring to FIG. 14, a preferred visual indication or display 51 is depicted, preferably located on one of two narrower walls 251 of generally rectangular housing of hand-held lighter 25 to permit viewing as one of two wider walls rests in a smoker's palm.

This display 51 is preferably a liquid crystal display which depicts icons indicative of the status of various functions of the lighter 25, and more broadly of the defined smoking system including cigarette 23. In addition, a backlight switch 630 is provided to enable the smoker to illuminate the display 51 for increased visibility, especially if ambient illumination is low.

If desired, any of the icons of this visual display could be coupled with a conventional tone, beep or other audio signal.

For example, icon 600 depicts a cigarette comprising a filter icon 602 defining a rectangular outline, i.e., current is supplied to define the dark outline, and a plurality of, e.g., eight, relatively smaller rectangular shaded areas 604, indicative of puffs remaining on an inserted cigarette 23, i.e., current is initially supplied to all of the rectangles. As a heater blade 120 is fired, current supply is terminated to a corresponding shaded area 604 to cause area 604 to either disappear or to define an outline.

Conversely, the areas 604 initially define an outline, and as a heater blade 120 is fired, current supply is terminated to a corresponding outline area 604 to cause area 604 to either disappear or to define a shaded area. Preferably, current supply to the area 604 located at terminal end of cigarette icon 600 opposite filter icon 602 is terminated at the first puff, and then current supply to successively adjacent areas 604 is terminated with successive draw-triggered, heater blade firings to alert the smoker both of the number of puffs remaining and the number of puffs taken on an inserted cigarette. Such iconography also simulates the burning of a combusted cigarette with the lighted end approaching the filter as the cigarette is smoked.

Other icons may be provided and displayed via display 51. These icons operate as described above to darken or lighten icons or icon segments. A battery-shaped rectangular icon 610 is provided to indicate the status of the batteries 37. Preferably, battery icon 610 comprises four distinct segments to correspond to the number of batteries 37. Specifically, battery icon 610 preferably comprises a single rectangular segment 612 having a relatively smaller, attached rectangular icon representing a battery terminal and further comprises three rectangular segments 614.

Figure 14:
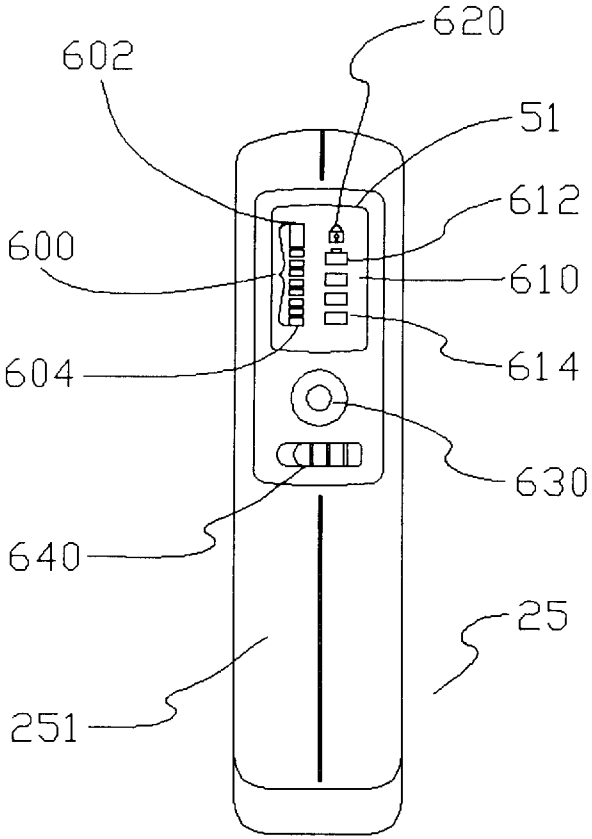
FIG. 14 is a side view of a lighter including an iconic display according to the present invention.

As described above with reference to cigarette icon 600, these rectangular battery icon segments 612 and 614 are preferably all darkened when the battery pack is fully charged and then are successively lighted and made invisible as a corresponding amount of battery pack is depleted during use. Preferably, the lowest, as depicted in FIG. 14, rectangular battery icon segment 614 is lighted first, followed by adjacent, successive rectangular battery icon segments 614, and then finally by single rectangular segment 612. The described darkening and lightening can be reversed.

Battery depletion is detected as described in related, commonly assigned U.S. patent applications Ser. No. 08/380,718; Ser. No. 07/943,504; Ser. No. 07/666,926, and to U.S. Pat. Nos. 5,388,594 and 5,249,586.

A lock icon 620 is also provided on display 51 and defines a rectangular area having an inverted U-shaped arch connected to an upper side of the rectangular area. This icon is activated when control logic 41 implements a "stop" mode which prevents firing of the heaters once the counter 55 sends a signal indicative of required cleaning to the control logic 41 of the lighter, as described above. By way of example, when this "stop" mode is implemented the entire lock icon 620 can be darkened or the inverted U-shaped arch can be darkened on the previously darkened remainder of the lock icon 620. Upon completion of the prescribed cleaning, either lighter control circuitry 41 and/or recharger logic controller 520, depending on the cleaning technique employed, implements a "go" mode to allow use to resume.

By way of example, when this "go" mode is implemented the entire lock icon 620 can be lighted and made invisible or the inverted U-shaped arch can be lighted and made on the darkened remainder of the lock icon 620. The described darkening and lightening can be reversed. Further, such a lock-out function could be implemented by depressing a backlight switch 630 for a period of time, e.g., approximately 3 to approximately 10 seconds, beyond an activation period for backlighting the display 51 or by any other smoker interface which serves to "lock" and "unlock" the lighter during periods of non-use. The lock icon 620 is also correspondingly activated and deactivated with this lock-out function.

Figure 15:
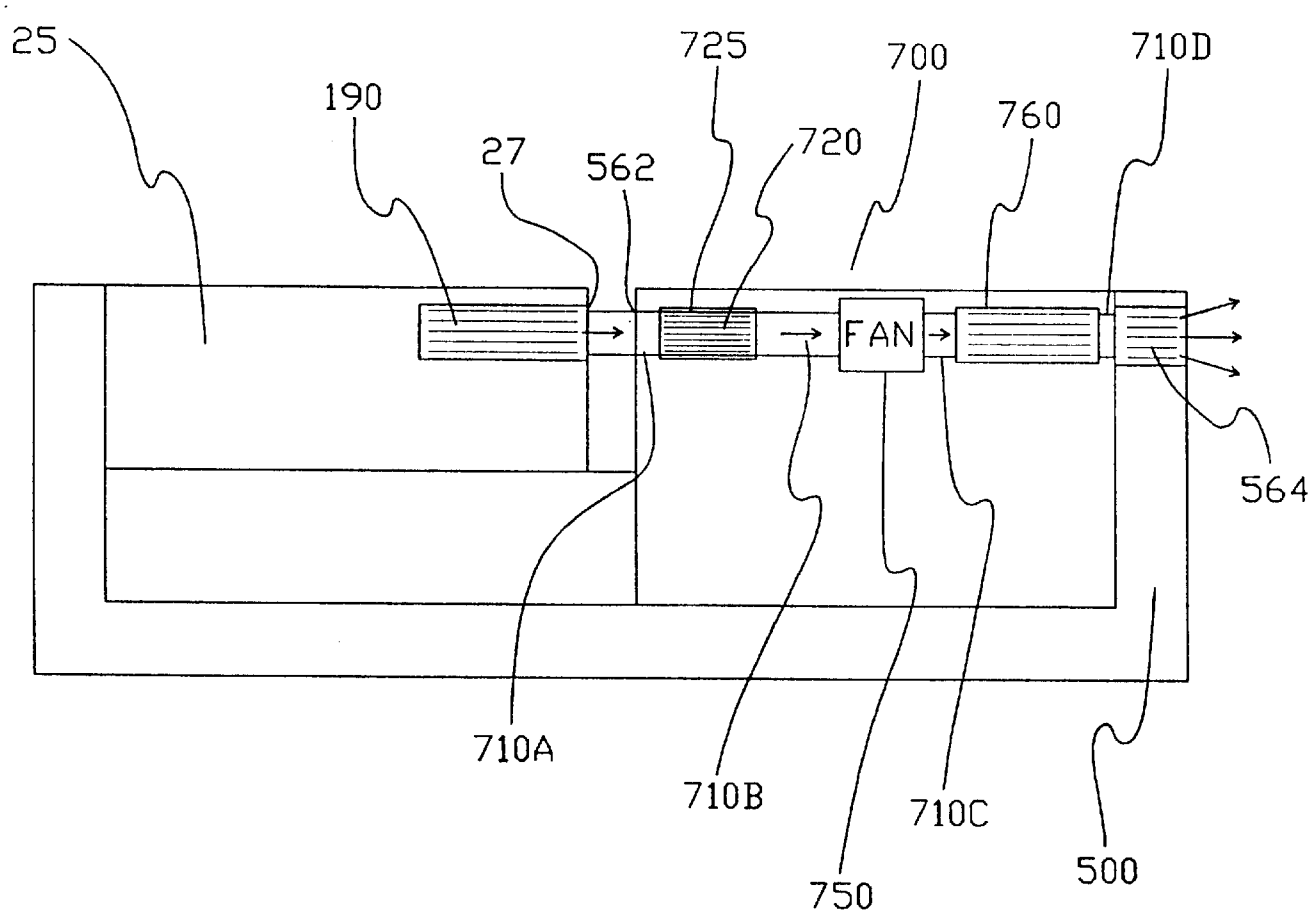
FIG. 15 is a side, exposed view of a recharger having a control system for minimizing release of liberated condensates from the electrical lighter.

Referring to FIG. 15, an alternative control system 700 is provided for controlling the amount of condensate released from orifice 27 of lighter 25. As shown, control system 700 is located within recharger unit 500, preferably connectable thereto to permit replacement of components such as the catalyst discussed below. A first tube or defined flow passageway 710A is provided which extends from entry port 562 of recharger unit 500 and at a first end engages, preferably in a fluid tight manner, orifice 27 to fluidly communicate with the cylindrical receptacle defined by the heater blades 120 when lighter 25 is engaged with the recharger unit.

A catalyst 720, described more fully below, is located in the flow path defined by tube 710A. A second tube section 710B, preferably an integral extension of tube 710A, fluidly communicates the catalyst 720 with a fan 750, a third tube 710C fluidly communicates the fan 750 with an air cooler/diffuser 760, and a fourth tube 710D fluidly communicates the air cooler/diffuser 760 with exit port 564 of recharger unit 500.

Catalyst 720 is preferably shaped to extend across the cross section of the defined passageway of the tube so that all of air flow impinges on and ultimately passes through the catalyst 720. For example, catalyst 720 has a circular cross section, e.g., is a porous cylinder, having a diameter which is slightly less than tube 710A such that the catalyst 720 is positioned therein in a fluid-tight manner. In one preferred embodiment, catalyst 720 is an approximately 8 mm by approximately 10–15 mm cylindrical porous plug. If desired, a sealant can be applied between catalyst 720 and the inner walls of tube 710A.

The catalyst 720 is preferably removable from recharger unit 500 for replacement upon eventual decay. Catalyst 720 preferably defines flow passages therethrough for the flow. For example, catalyst 720 is porous, e.g, having a porosity of approximately 75% to approximately 95%, e.g, having a porosity of approximately 85% to approximately 90%, e.g., having a surface area of approximately 16,000 square meters per cubic meter ($m^2/m^3$) to approximately 2,000 square meters per cubic meter ($m^2/m^3$). The pressure drop across catalyst 720 increases with decreasing porosity.

For example, catalyst 720 comprises a porous ceramic foam plug support such as cordierite with a high surface area alumina washcoat commercially available from Hi-Tech Ceramics, Inc. of Alfred, N.Y., e.g., containing approximately 80 to approximately 10 pores per linear inch, e.g., 45 pores per linear inch. Cordierite is selected because of its relatively low coefficient of thermal expansion and therefore desirable thermal shock resistance during heating.

This porous ceramic support is then coated with an appropriate stable and long lasting catalyst such as platinum or a platinum alloy. In one preferred embodiment, the platinum source is chloroplatinic acid, $H_2PtCl_6.6H_2O$, and is applied by any suitable process such as incipient wetness. For example, the porous ceramic foam plug is submerged in a concentrated alcoholic solution of chloroplatinic acid, $H_2PtCl_6.6H_2O$, and optionally subjected to an ultrasonic bath to ensure adequate penetration and coating.

Next, the porous ceramic foam plug is removed from the solution; excess solution removed, e.g., by shaking; and then the porous ceramic foam plug is dried in an oven at approximately 70° C. to approximately 75° C. The dried porous ceramic foam plug is then placed in a furnace, the temperature of the furnace raised to approximately 900° C. at approximately 50° C./min. and held in air at approximately 900° C. for approximately 30 minutes, and then the porous ceramic foam plug is cooled to room temperature. Other support materials such as metal gauzes/foils, quartz wool, ceramic honeycomb, etc., are also suitable, commercially available supports.

Photocatalytic degradation, using an ultraviolet light source and catalyst, may also be used to degrade the volatiles to carbon dioxide and water. More preferably, the ultraviolet light source is encased in glass coated with az porous titania membrane catalyst having an applied electrostatic charge.

Returning to heat degradation, a catalytic preheater 725 is preferably provided within the recharger unit 500 to preheat and heat catalyst 720 to a suitable operative surface temperature of, e.g., approximately 300° C., and is preferably thermally insulated from the remainder of recharger unit 500.

Preferably, the catalyst is preheated between approximately 275° C. and approximately 350° C. prior to the initiation of the heating of condensate sleeve 200 as discussed. In a preferred embodiment, the catalyst is preheated to approximately 300° C. Heater 725 can be any suitable heat source such as a resistively heated wire, e.g., Nichrome® brand alloy discussed above, or a cylindrical heater such as shown in FIG. 8A–8B which surrounds both the tube 710A and the catalyst 720 located therein.

Preferably, the tubes, and at least tube 710A and 710B, are able to withstand those temperatures, for example, the tubes are glass. In addition, sufficient oxygen must be present to support the catalytic oxidation of the released condensate.

For example, fan 750 preferably establishes an air flow of approximately 300 cc/min to approximately 1200 cc/min, e.g., approximately 500 cc/min. An electrostatic precipitator and/or filter(s) can be added in-line between the catalyst 720 and exit port 564 to complement or replace catalyst 720. The components of control system 700 are shown in a linear arrangement but can be configured as desired, e.g., in a semicircular or other configuration to conserve space.

As discussed previously, condensates are volatilized and thermally liberated from sleeve 200. Fan 750 draws these liberated, air-borne condensates out of lighter 25 via orifice 27, toward porous catalyst 720 via tube 710A, and then through porous catalyst 720, which catalyzes the condensates to form primarily water vapor and carbon dioxide.

The resulting decomposition products do not exhibit a significant visible component, i.e., no visible aerosol, or a significant odor. Fan 750 then draws this flow of water vapor and carbon dioxide to air cooler/diffuser or heat exchanger 760 for cooling and diffusion and then exhausts the flow from the recharger unit 500 via tube 710D and exit port 564.

Preferably, fan 750 establishes a flow rate., e.g., approximately 300 cc/min. to approximately 1200 cc/min, e.g., greater than approximately 300 cc/min or approximately 500 cc/min.

The foregoing cleaning and maintenance apparatuses and methods are also applicable to the electrical lighter with tobacco web described in commonly assigned copending patent application Ser. No. 08/105,346 filed Aug. 10, 1993, which is hereby incorporated by reference.

The method and apparatus for cleaning an electrical smoking system according to the present invention thus permits repeated cleanings of a lighter over the life of the lighter without the need to replace numerous condensate accumulators. The described periodic heating of a condensate accumulation surface cleans this accumulation surface as well as other component surfaces which are subject to condensation.

A technique is described to heat this accumulation surface using the lighter power source. Also, the smoker is alerted that cleaning is or will soon be required. In addition, a contemporaneous full cleaning cycle and initiation of a recharge cycle simplifies use of the lighter 25 and establishes a routine, e.g., a daily routine, for the smoker. Lighter logic is also simplified by performing a single counting of cigarette heater firings, cigarettes smoked, etc. both for recharging and cleaning. Further, a single icon and/or tone as discussed below can be employed to alert the smoker that recharging and cleaning are required.

This contemporaneous full cleaning cycle and initiation of a recharge cycle also increases the effectiveness of the cleaning since condensate accumulation is reduced by the routine, e.g., daily, cleaning. Accordingly, the present invention provides a cleaning apparatus which avoids adverse effects on the subjective taste of subsequent cigarettes; blockage of required airflow passages, especially the passageway communicating with the puff sensitive sensor and/or with outside ambient air; damage to sensitive electronic and electrical components; and protrusions, snags, etc. which could adversely affect insertion, registration and removal of cigarettes relative to the heater fixture.

Many modifications, substitutions and improvements may be apparent to the skilled artisan without departing from the spirit and scope of the present invention as described and defined herein and in the following claims.

We claim:

1. An apparatus for cleaning or maintaining an electrical lighter having an interior, which lighter heats tobacco and/or a tobacco-containing material inserted into the interior of the electrical lighter to evolve flavors to be delivered to a smoker, which evolved flavors form a condensate within the lighter, the cleaning apparatus comprising:

a surface element for collecting condensate from a portion of the evolved flavors not delivered to a smoker;

a heating element for heating the surface element to thermally liberate the collected condensates; and a controller for controlling the heating of said heating element a sufficient amount to thermally liberate the condensates, whereby the surface element is cleaned of at least some of the condensates upon heating of said heating element.

2. The apparatus according to claim 1, wherein said surface element comprises a substantially cylindrical inner surface.

3. The apparatus according to claim 2, wherein said surface element comprises a sleeve.

4. The apparatus according to claim 2, further comprising a reflector reflecting heat from said heated surface element back toward said surface element.

5. The apparatus according to claim 2, wherein the sleeve is formed with an outer surface having an outer spiral groove containing the heating element spiralled in the outer spiral groove.

6. The apparatus according to claim 5, wherein the sleeve is formed with an inner surface having an inner spiral groove corresponding to said outer spiral groove to direct drawn air circumferentially around the tobacco.

7. The apparatus according to claim 3, wherein said sleeve is swaged.

8. The apparatus according to claim 3, wherein said heating element is spiralled in proximity to a surface of said sleeve.

9. The apparatus according to claim 3, wherein said heating element is formed upon or into the sleeve in a serpentine pattern.

10. The apparatus according to claim 1, wherein the surface is ceramic, cermet, or metal.

11. The apparatus according to claim 1, wherein the lighter has at least one heater blade internal to said surface, and there is a gap of from 0.010 to 0.120 inches between said surface and the heater blade.

12. The apparatus according to claim 1, wherein the lighter has internal parts and circuitry, and the surface element is an aerosol barrier between the tobacco or tobacco containing material and the internal parts and circuitry.

13. The apparatus according to claim 1, wherein said heating element comprises a resistive heating element having a first terminal end connected to a source of electrical energy and a second terminal end connected to the source of electrical energy.

14. The apparatus according to claim 1, wherein the surface element is coated with an insulating material, and the heating element is an electrically resistive material disposed on the insulator.

15. The apparatus according to claim 14, wherein said surface element is electrically conductive and forms a circuit with the electrically resistive heating element.

16. The apparatus according to claim 14, further comprising a additional insulator, said additional insulator disposed on said heating element.

17. The apparatus according to claim 1, wherein said heating element comprises an inductively heated sleeve.

18. The apparatus according to claim 17, wherein the inductively heated sleeve has a corresponding exciter coil which draws 5–25 amps.

19. The apparatus according to claim 18, wherein the exciter coil is located in the lighter.

20. The apparatus according to claim 18, wherein the exciter coil is located external to the lighter.

21. The apparatus as claimed in claim 1, wherein the heating element comprises a movable heating element which is inserted into the interior of the lighter during a cleaning cycle.

22. The apparatus according to claim 1, wherein the heating element comprises at least one heater blade normally used for heating the tobacco or tobacco containing material.

23. The apparatus according to claim 1, further comprising an indicator which indicates when said surface element requires cleaning.

24. The apparatus according to claim 23, wherein the indicator is activated after a predetermined number of heatings of the tobacco.

25. The apparatus as claimed in claim 23, wherein the indicator is an iconic display.

26. The apparatus according to claim 23, wherein the indicator is cooperatively coupled to the controller or heater and prevents heating of the tobacco if the surface element requires cleaning.

27. The apparatus according to claim 26, wherein said heating element heats said surface element for approximately 10 to approximately 120 seconds.

28. The apparatus according to claim 1, further comprising a sensor which determines the presence of inserted tobacco in the electrical lighter, said sensor being cooperatively coupled to the controller or heater and preventing cleaning of said surface element if tobacco is present in the electrical lighter.

29. The apparatus according to claim 1, wherein said heating element heats said surface element between 150° C. and 750° C.,±50° C.

30. The apparatus according to claim 29, wherein said heating element heats said surface element for approximately 10 seconds to approximately 120 seconds.

31. The apparatus according to claim 1, wherein said heating element heats said surface element between 400° C. and 500° C.,±50° C.

32. The apparatus according to claim 1, further comprising a thermally liberated condensate containment device which reduces the amount of an effluent.

33. The apparatus according to claim 32, wherein the containment device comprises an electrostatic precipitator for insertion into the interior of the lighter for collecting condensates thermally liberated from said surface element.

34. The apparatus as claimed in claim 33, wherein the containment device is cigarette shaped and is inserted into the lighter.

35. The apparatus according to claim 32, wherein the containment device comprises a catalyst and ultraviolet light source.

36. The apparatus according to claim 35, wherein the ultraviolet light source is encased in glass coated with a porous titania membrane catalyst.

37. The apparatus according to claim 36, wherein an electrostatic charge is applied to the membrane.

38. The apparatus according to claim 33, wherein the containment device comprises a filter and conduit for directing the thermally liberated condensates to said filter.

39. The apparatus according to claim 38, wherein the filter comprises charcoal.

40. The apparatus according to claim 39, wherein the filter comprises a statically charged medium.

41. The apparatus as claimed in claim 32, wherein the containment device comprises a catalyst for catalyzing the decomposition of the thermally liberated condensates and conduit for directing the thermally liberated condensates to said catalyst.

42. The apparatus according to claim 41, wherein the catalyst is supported upon a porous support.

43. The apparatus according to claim 42, wherein the porous support has a porosity of approximately 75% to approximately 95%.

44. The apparatus according to claim 42, wherein said porous support comprises cordierite.

45. The apparatus according to claim 42, wherein said porous support is selected from the group consisting of ceramic foam, ceramic honeycomb, metal gauze or quartz wool.

46. The apparatus according to claim 41, wherein said catalyst comprises platinum.

47. The apparatus according to claim 41, wherein said catalyst is derived from chloroplatinic acid.

48. The apparatus according to claim 41, further comprising a heater for preheating said catalyst.

49. The apparatus according to claim 41, wherein the catalyst is disposable or reusable.

50. The apparatus according to claim 1, further comprising a cooling device to reduce the temperature of the thermally liberated condensates.

51. The apparatus according to claim 50, wherein the cooling device is a heat exchanger.

52. The apparatus according to claim 41, further comprising a fan for providing a flow of air through the conduit.

53. The apparatus according to claim 52, wherein the air flow is approximately 300 cc/min. to approximately 1200 cc/min.

54. The cleaning apparatus according to claim 1, wherein said surface element comprises a cylindrical sleeve, an inner surface of said cylindrical sleeve is separated from the heated tobacco by a gap, and an outer surface of said cylindrical sleeve directs drawn air along said outer surface and said inner surface of said cylindrical sleeve directs the air along said inner surface, further comprising a distributor for substantially uniformly dispersing drawn air along said inner surface of said cylindrical sleeve.

55. The cleaning apparatus according to claim 54, wherein said distributor comprises an annular member disposed on said outer surface of said cylindrical sleeve and defining an air distribution pattern.

56. The apparatus according to claim 1, wherein said surface element defines a substantially cylindrical inner surface, the electrical lighter heats the tobacco or tobacco containing material by a plurality of tobacco heating elements which form a cylindrical cigarette receiving arrangement, and the substantially cylindrical inner surface faces the cylindrical cigarette receiving arrangement formed by said plurality of heaters.

57. The apparatus according to claim 56, wherein the heating elements comprise the plurality of tobacco heating elements, and the apparatus further comprises a source of electrical energy connected to said plurality of heaters, said controller controlling the supply of electrical energy, wherein said controller comprises a pulse width modulator to supply a predetermined amount of electrical energy to each of said plurality of tobacco heaters in succession.

58. The apparatus according to claim 57, wherein said pulse width modulator modulates the supply of electrical energy to said plurality of heaters such that electrical energy is supplied to each heaters approximately 20 to approximately 200 times per second.

59. The apparatus according to claim 1, wherein the lighter further comprises a rechargeable battery, and the apparatus further comprises a supply of electrical energy to the rechargeable battery of the electrical lighter, and a charge regulator for controlling the supply of electrical energy to the rechargeable battery of the electrical lighter.

60. The apparatus according to claim 59, wherein when said battery is fully charged, the regulator generates a signal and communicates the generated signal to the controller to permit subsequent heating of tobacco.

61. The apparatus according to claim 59, wherein the apparatus comprises a base unit and hand-held lighter; the base unit is formed with at least one battery-charging slot which is formed to accept the rechargeable battery in electrical contact with the supply of electricity; and the base unit is formed with a lighter receiving socket which accepts the hand-held lighter.

62. The apparatus according to claim 61, wherein the lighter is in electrical contact with the base unit.

63. The apparatus according to claim 61, wherein there is one battery charging slot.

64. The apparatus according to claim 63, wherein there are two battery charging slots.

65. A chamber for generating a localized and controlled heat source, said chamber comprising a geometric form having a longitudinal wall with an integral spiral groove, said wall having an internal and external surface, said groove defining a baffle on said internal surface and an electrical resistance path on the external surface, whereby the interior of the chamber may be heated by the application of electricity to the resistive path.

66. A chamber as claimed in claim 65, wherein the longitudinal wall is a sleeve, and the sleeve is externally coated with a ceramic, and said ceramic is overlaid with the resistive element.

67. An apparatus for cleaning and recharging a lighter of an electrical smoking system, said lighter having a condensate sleeve for trapping condensate formed during electrically powered smoking of tobacco or a tobacco containing flavor medium, said cleaning and recharging apparatus comprising a base unit which is connected to a source of electrical energy, a transformer located within said base unit for converting alternating current to direct current, a receptacle in said base unit for insertion of a lighter containing a battery, said receptacle being in electrical connection with the transformer, a heater in thermal proximity to the condensate, control circuitry for controlling the recharge and cleaning of the lighter, said control circuitry utilizing transformed direct current energy to charge the battery and thermally liberate condensate from the lighter by activating the heater, and an exhaust port for removing condensate liberated during cleaning of the lighter.

68. An apparatus as claimed in claim 67, wherein the heater comprises a heating element located on the surface of a condensate sleeve.

69. An apparatus as claimed in claim 67, wherein the heater comprises a plurality of heating elements within the condensate sleeve, said heating elements being configured to heat tobacco during normal use of the lighter as a smoking system.

* * * * *